US007083344B2

(12) United States Patent
Miyasaka et al.

(10) Patent No.: US 7,083,344 B2
(45) Date of Patent: Aug. 1, 2006

(54) LABEL PRINTER WITH SELECTIBLE DISPENSIBLE MODES FOR PEELING AND NON-PEELING MODES

(75) Inventors: Masayo Miyasaka, Suwa (JP); Go Hiroike, Suwa (JP); Kazuko Fukano, Suwa (JP); Toru Takami, Suwa (JP); Koji Yamada, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/176,093

(22) Filed: Jul. 7, 2005

(65) Prior Publication Data

US 2006/0008311 A1 Jan. 12, 2006

(30) Foreign Application Priority Data

Jul. 8, 2004 (JP) ..... 2004-201880
Aug. 9, 2004 (JP) ..... 2004-232776

(51) Int. Cl.
*B41J 11/42* (2006.01)
*B41J 13/26* (2006.01)

(52) U.S. Cl. ..... 400/613; 400/582

(58) Field of Classification Search ..... 400/613, 400/619, 582, 583, 594.1; 156/384, DIG. 45
See application file for complete search history.

(56) References Cited

U.S. PATENT DOCUMENTS

| | | | | |
|---|---|---|---|---|
| 5,209,374 | A * | 5/1993 | Seidl-Lichthardt | 221/73 |
| 5,496,116 | A * | 3/1996 | Senda | 400/61 |
| 5,980,138 | A | 11/1999 | Shiozaki et al. | 400/582 |
| 6,068,419 | A | 5/2000 | Shiozaki et al. | 400/582 |
| 6,530,705 | B1 * | 3/2003 | Petteruti et al. | 400/611 |

FOREIGN PATENT DOCUMENTS

| | | | |
|---|---|---|---|
| JP | 05-116407 | | 5/1993 |
| JP | 06-156463 | | 6/1994 |
| JP | 401656463 | A * | 6/1994 |
| JP | 8-295323 | | 11/1996 |
| JP | 408295323 | A * | 11/1996 |
| JP | 11-314624 | | 11/1999 |
| JP | 11314624 | * | 11/1999 |
| JP | 2000-094732 | | 4/2000 |
| JP | 02003170619 | A * | 6/2003 |

* cited by examiner

*Primary Examiner*—Andrew H. Hirshfeld
*Assistant Examiner*—Wasseem H. Hamdan
(74) *Attorney, Agent, or Firm*—Mark P. Watson

(57) ABSTRACT

In a label printer in which either a peeling mode or non-peeling mode can be selected as the label dispensing mode, labels are printed and thus wasted when the operator loads the label paper into a transportation path that does not match the desired dispensing mode. This problem is solved by a label printer enabling selecting as the printing configuration either a peeling configuration for peeling printed labels from the web of label paper 11, or a non-peeling configuration in which the printed labels are not separated from the web of the label paper 11. A printing configuration selection unit 27 enables selecting which printing configuration to use. To operate in the non-peeling mode, the label paper 11 is loaded into a first paper transportation path A. To operate in the peeling mode, the label paper 11 is loaded to a second paper transportation path B. A cover unit 2 can be opened and closed to enable handling the label paper, and takes the label printer off-line when the cover unit 2 is opened. A mode selection switch 19 is accessible only when the cover unit is open and operating the mode selection switch causes the printing configuration selection unit 27 to change the printing configuration.

9 Claims, 22 Drawing Sheets

LABEL PRINTER WITH SELECTIBLE DISPENSIBLE MODES FOR PEELING AND NON-PEELING MODES

BACKGROUND OF THE INVENTION

1. Field of the Invention

The present invention relates to a label printer having a label peeling mechanism for peeling printed labels from the web liner.

2. Description of the Related Art

Label printers for printing and peeling labels from the web liner on which the labels are carried are known from the literature. The label printer taught in Japanese Unexamined Patent Appl. Pub. H08-295323 (corresponding to U.S. Pat. No. 5,980,138), for example, conveys label paper having adhesive labels of a known constant length affixed to a web past a printing unit whereby the labels are printed. This label printer then conveys the printed label paper at an acute angle though a label peeling unit to sequentially peel the labels one by one from the web and dispense the printed peeled labels from a dispenser opening while detecting the labels with a peeled label detector.

This mode of printing and peeling the labels one by one is referred to as the "peeling mode."

The foregoing label printer can also operate in a "non-peeling mode" in which a specified number of labels are printed continuously without an accompanying label peeling operation. In this mode the labels are output without being peeled from the liner.

Because the labels are dispensed in the non-peeling mode without peeling the labels from the web, the paper transportation path downstream from the printing unit in the non-peeling mode is different from the peeling mode. When loading label paper the operator must therefore choose which paper transportation path to use downstream from the printing unit according to which label dispensing mode will be used.

A paper feed operation used when printing and dispensing labels in the peeling mode is also different in the non-peeling mode. More specifically, the label paper is conveyed continuously in the non-peeling mode and is conveyed intermittently in the peeling mode. Changing the dispensing mode is thus not limited to simply changing the paper transportation path, and also requires changing paper feed control and printing control.

Whether the label paper is installed in the paper transportation path for the non-peeling mode or the peeling mode cannot, however, be recognized by a printer according to the prior art. As a result, a subcommand for identifying the dispensing mode of the label dispensing command is added to the printer commands sent from the host computer to the printer and sent to the printer to change the label-dispensing mode.

This method makes changing the label-dispensing mode difficult, however, when the label-dispensing mode must be changed on site where the labels are printed. Addressing the problem of the label paper being loaded to different paper transportation paths in the non-peeling mode and peeling mode, Japanese Unexamined Patent Appl. Pub. H08-295323 (corresponding to U.S. Pat. No. 5,980,138) teaches disposing a web sensor in the transportation path that is used in the peeling mode so that the label printer can detect when the label paper is loaded for the peeling mode, and thus automatically select the label dispensing mode for printing and label dispensing.

The foregoing label printer also has a printer cover that opens and closes the printer housing to enable replacing the label paper and removing paper jams in the paper transportation path. The printer cover can thus be opened to open the label paper compartment so that the label paper can be replaced. The printer cover can also be opened to open the paper transportation path so that paper jams can be removed.

The front cover (printer cover) is positioned on the front of the printer housing in the printer taught in Japanese Unexamined Patent Appl. Pub. H08-295323 (corresponding to U.S. Pat. No. 5,980,138) so that the hopper (label paper compartment) for holding a roll of label paper and the peeling unit (label peeling mechanism) can be opened and closed freely.

The trouble with this printer cover is that the printer cover must be opened completely even to simply change the paper transportation path, and thus the label-dispensing mode, without changing the label paper. This is particularly a problem when the cover is large because a large space is required to open and close the cover.

Furthermore, the host computer must be informed of a mode change when the label paper transportation path is changed to change the label-dispensing mode. The apparatus taught in Japanese Unexamined Patent Appl. Pub. H08-295323 (corresponding to U.S. Pat. No. 5,980,138), however, positions the label sensor in the peeling mode transportation path to detect the label-dispensing mode and automatically print accordingly. The labels are thus printed in the wrong mode if the operator loads the label paper in the wrong transportation path, and the resulting labels are thus typically wasted. For example, if the labels are normally dispensed in the peeling mode and applied to products one at a time, but the label paper is mistakenly loaded in the transportation path for the non-peeling mode, the labels will be continuously printed and dispensed intact on the web. This could result in an entire roll of labels being wasted if a large number of labels is dispensed.

OBJECTS OF THE INVENTION

The present invention is directed to solving the foregoing problem, and an object of this invention is to provide a label printer whereby the paper transportation path can be easily changed in a small opening and closing space when changing the label dispensing mode, and printed labels are not wasted when the operator changes the label dispensing mode as desired.

SUMMARY OF THE INVENTION

To achieve the foregoing object, the present invention provides a label printer, enclosed by a printer housing that enables selection of a peeling mode for peeling printed labels from a label paper web or a non-peeling mode for continuously outputting printed labels without separating the labels from the label paper web. This label printer has a first paper transportation path through which the label paper is inserted in the non-peeling mode; a second paper transportation path through which the label paper is inserted in the peeling mode; a cover unit that is openable to allow handling of the label paper inside the printer housing; a mode selection switch that is accessible only when the cover unit is open and which outputs a selection signal according to the label dispensing mode selected when the mode selection switch is operated; and a label dispensing mode selection unit that selects the label dispensing mode used for operation according to the selection signal output by the mode selection switch.

Thus comprised, the operator can change the label-dispensing mode when desired even while the label printer is operating because the mode selection switch is located inside the printer housing. As a result, the operator can quickly change the dispensing mode if the label paper is loaded in the wrong paper path, and wasted label printing can thus be reduced.

Furthermore, because the mode selection switch is inaccessible when the cover unit is closed, the likelihood of the switch being mistakenly operated is reduced as compared with an arrangement in which the mode selection switch is externally exposed.

The label printer further preferably has a cover opening detection unit that takes the label printer off-line when the cover unit is open.

This arrangement enables taking the printer off-line when the cover unit is opened.

Yet further preferably, the mode selection switch is a slide switch and the position of the switch can be seen externally, i.e. from outside the printer housing.

The current setting of the mode selection switch, which cannot be accessed when the cover unit is closed, can thus be easily visually observed.

Yet further preferably, the mode selection switch is a pushbutton switch that is enabled only one time when the cover unit is opened, and a one-time activation of the pushbutton switch causes the label-dispensing mode selection unit to change the label-dispensing mode This prevents the label-dispensing mode from becoming indeterminable when the mode selection switch is unintentionally operated more than once.

Yet further preferably, the label printer also has a paper detector that detects the presence of the label paper web in the second paper transportation path; and an error indicator that indicates an error when the label-dispensing mode selected by the label-dispensing mode selection unit and the paper path in which the label paper is inserted do not match.

The operator can thus know that the selected label-dispensing mode and the path of the label paper do not match, and can thereby quickly correct the problem.

Yet further preferably, the cover unit comprises a label peeling mechanism for peeling labels from a web conveyed through a curved path by bending printed label paper acutely from the back side, and having a peeled label detector for detecting peeled labels; wherein the label peeling mechanism is openable and closable from the cover unit, so that the first paper transportation path and second paper transportation path can be opened.

Less space is needed to open the first transportation path and the second transportation path to change the path through which the label paper is loaded in this arrangement because the printer cover remains closed when the label peeling mechanism is opened to change the label-dispensing mode.

The label-dispensing mode can therefore be changed in a smaller working space because opening the printer cover, which requires a large space to open, is not necessary.

Yet further preferably, the mode selection switch is covered by the label peeling mechanism so that the switch is inaccessible when the label peeling mechanism is closed.

Because the mode selection switch cannot be accessed when the label peeling mechanism is closed, the likelihood of the switch being accidentally operated is reduced compared with when the mode selection switch is externally exposed.

A printer cover sensor is further included to take the printer off-line when the printer cover is opened and return the printer on-line when the cover is closed. The mode selection switch detects which mode is set when the printer cover is closed and the printer returns on-line.

User access to the mode selection switch is thus prohibited when the printer cover is not open. The user cannot operate the mode selection switch unless the printer cover is open. This aspect of the invention thus prevents the user from changing the mode accidentally.

Further preferably, the label printer also has a mode indicator that displays externally to the printer housing the label-dispensing mode selected by the mode selection switch.

The position of the mode selection switch, which is located inside the printer housing and cannot be accessed when the label peeling mechanism is closed, can thus be easily visually observed.

Because the mode selection switch is located inside the printer housing in a label printer according to the present invention, the operator can change the label-dispensing mode when desired even while the label printer is operating. As a result, the operator can quickly change the dispensing mode if the label paper is loaded into the wrong paper path, and wasted label printing can thus be reduced.

Furthermore, less space is needed to open the first transportation path and the second transportation path to change the path through which the label paper is loaded because the printer cover remains closed when the label peeling mechanism is opened to change the label-dispensing mode.

The present invention thus provides a label printer enabling changing the paper transportation path in a small opening and closing space when the label dispensing mode is changed, and prevents wasting printed labels when the operator changes the label dispensing mode as desired.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A label printer according to a preferred embodiment of the present invention is described below with reference to the accompanying figures.

Figure 1:
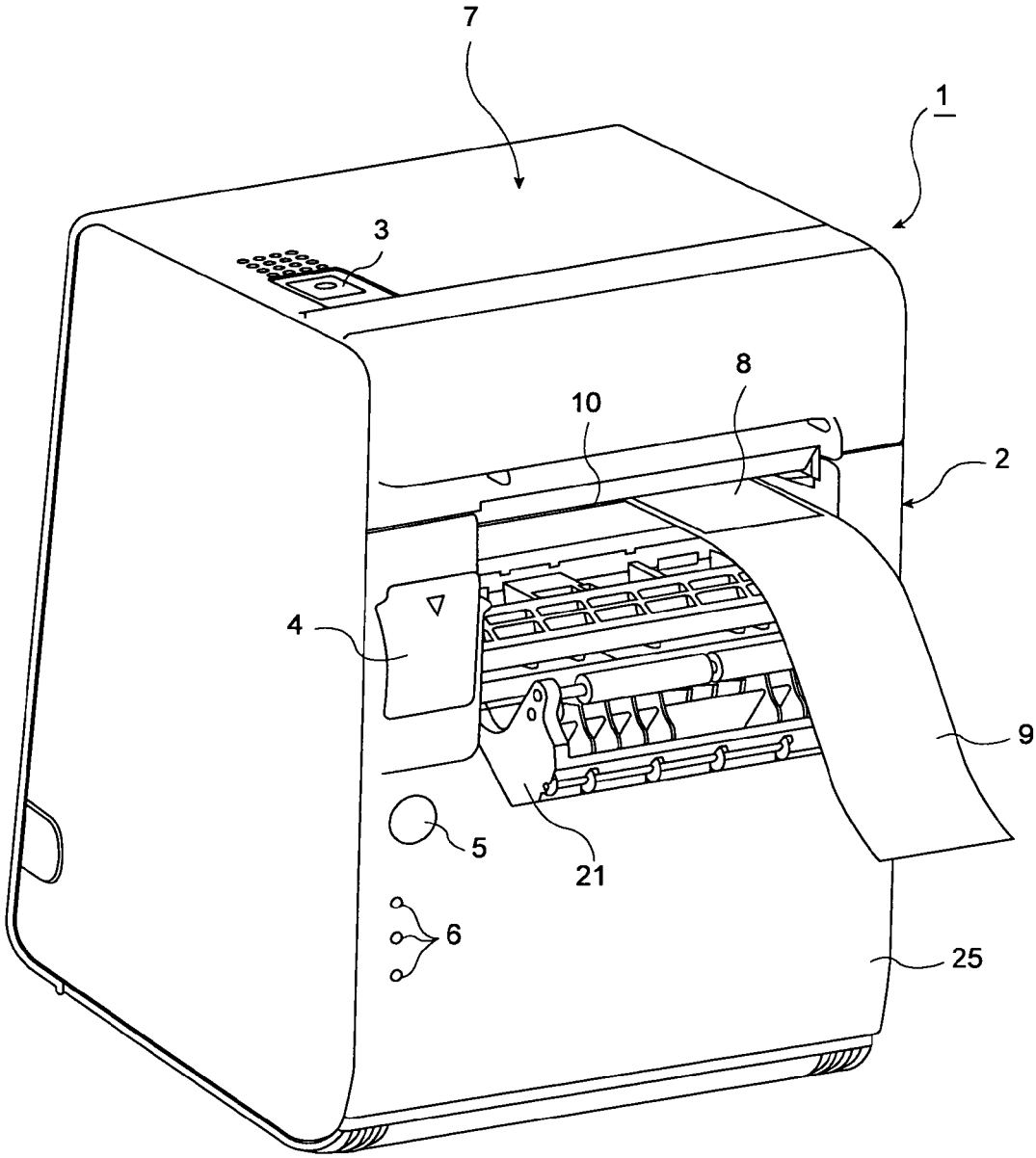
FIGS. 1 to 3 are oblique external views of a label printer according to a first embodiment of the invention, showing how the label paper is routed through (FIGS. 1 and 2) and discharged from (FIG. 3) the label printer.
Figure 2:
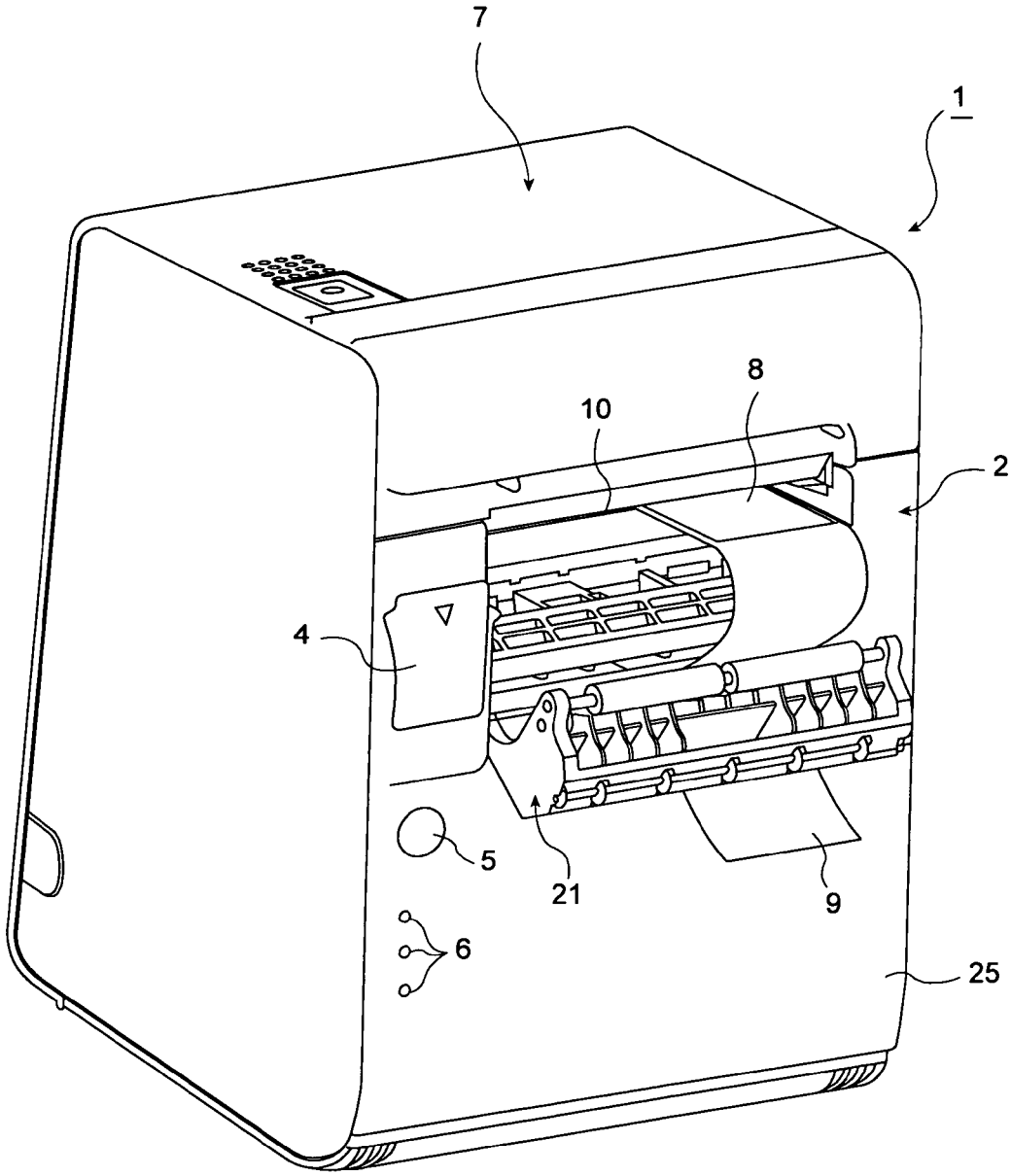
Figure 3:
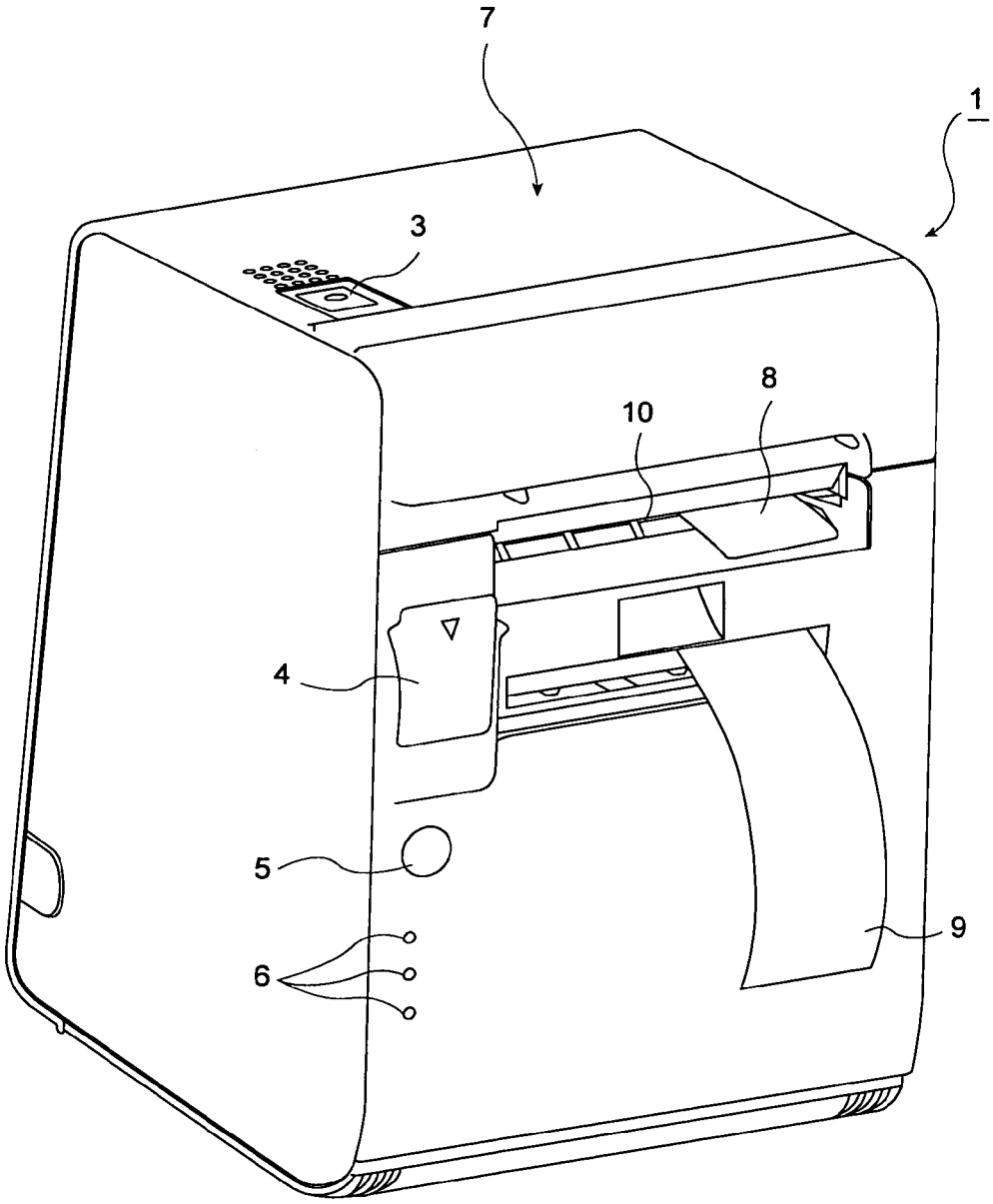
Figure 4:
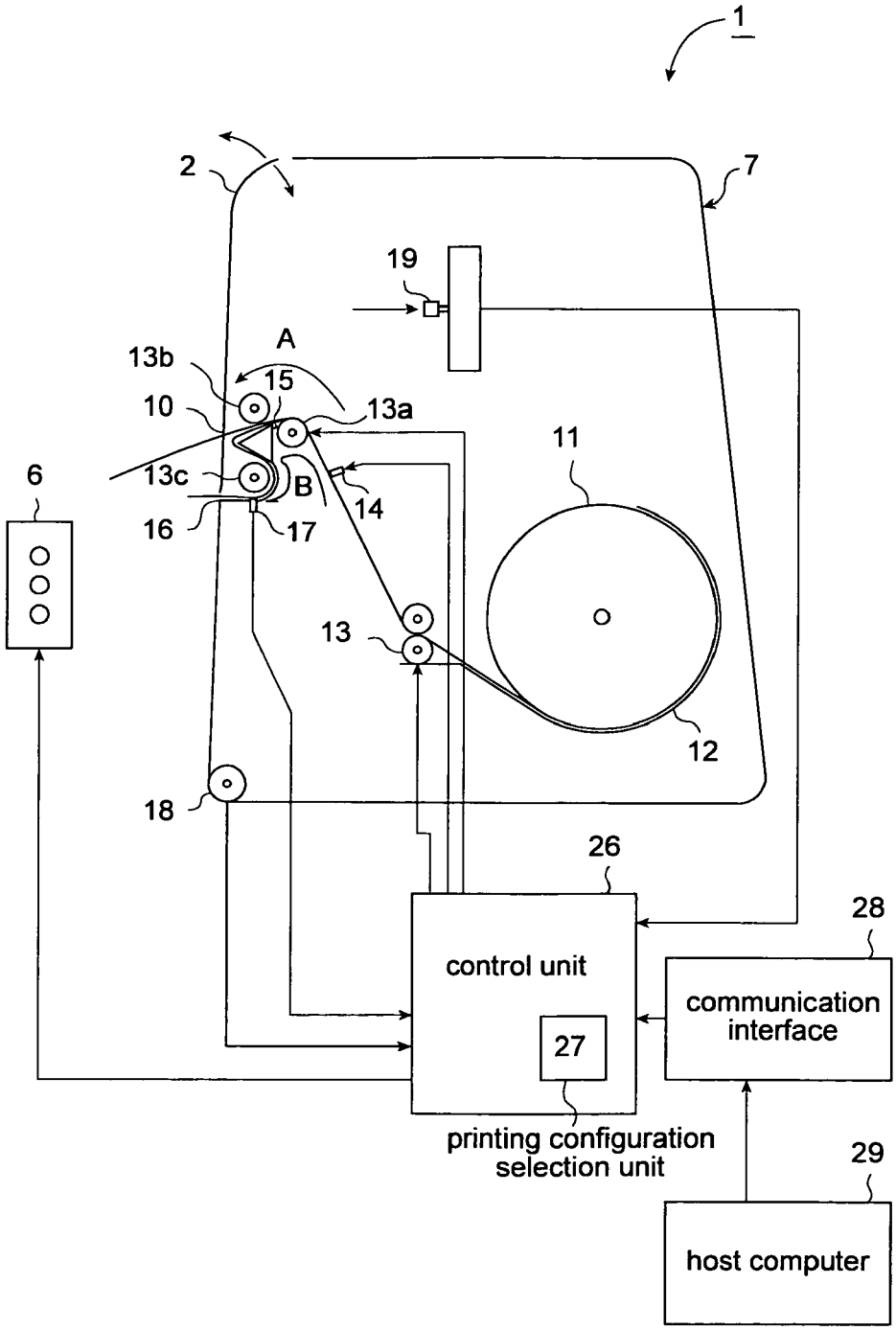
FIG. 4 is a schematic section view and block diagram of the label printer shown in FIG. 3.
Figure 5:
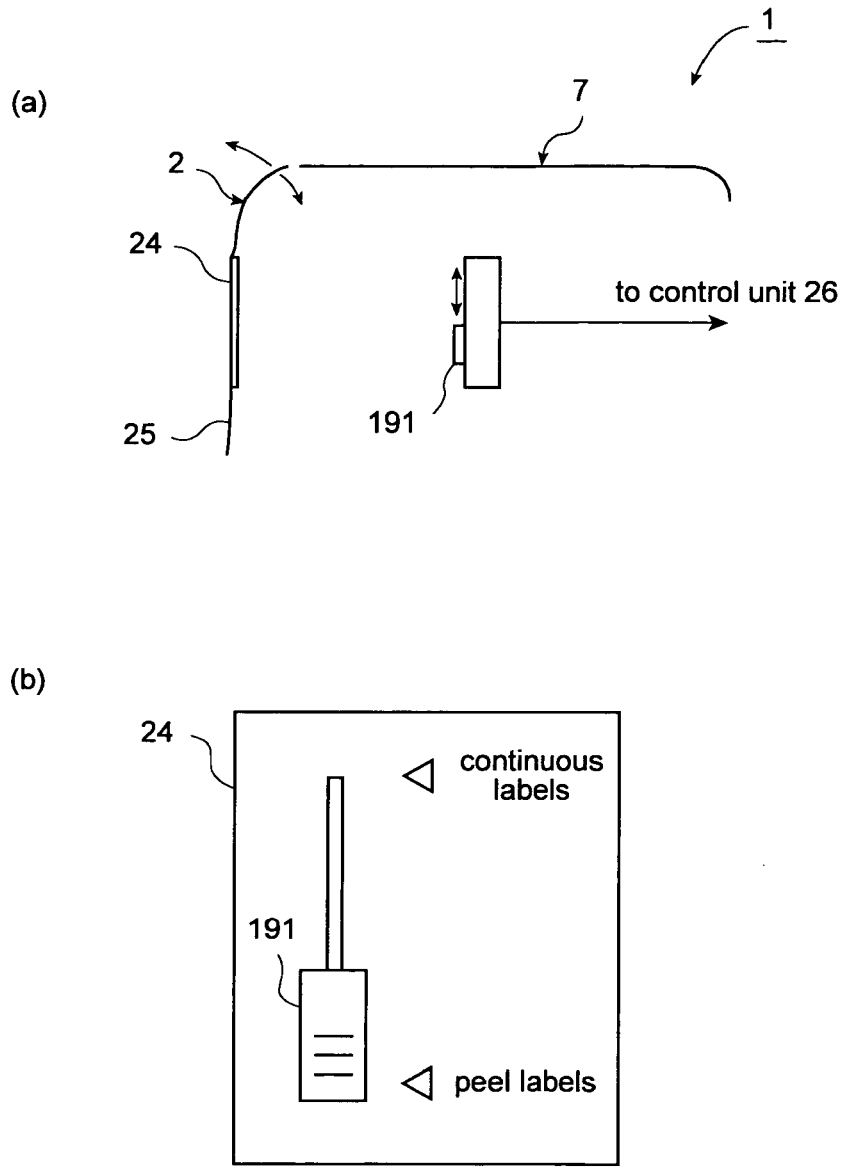
FIG. 5 is a section view of the label printer when the mode selection switch shown in FIG. 4 is a slide switch.
Figure 6:
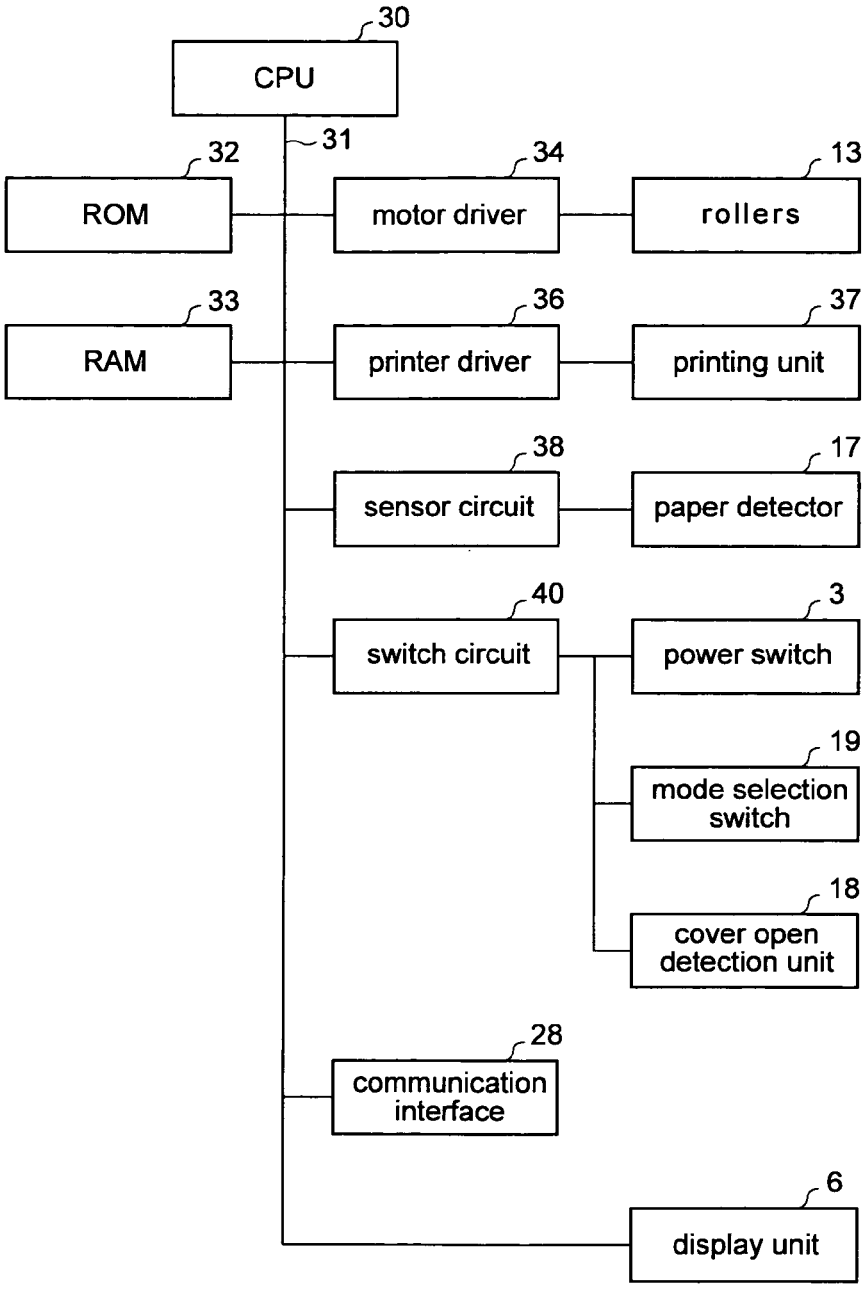
FIG. 6 is a block diagram of the control system of the label printer according to a first embodiment of the invention.
Figure 7:
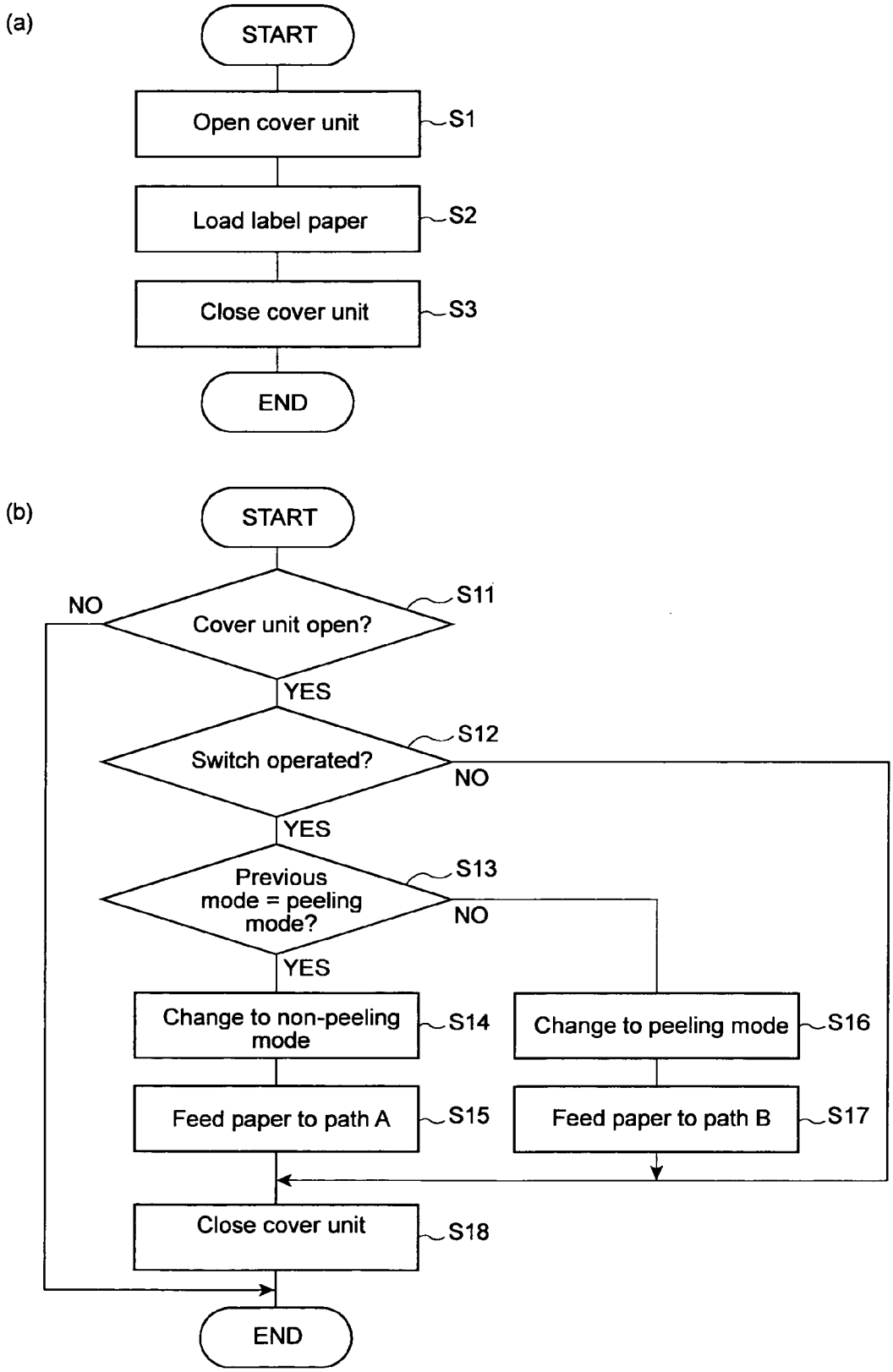
FIG. 7 is a flow chart of (a) the paper loading process, and (b) a process for changing the printer configuration.
Figure 8:
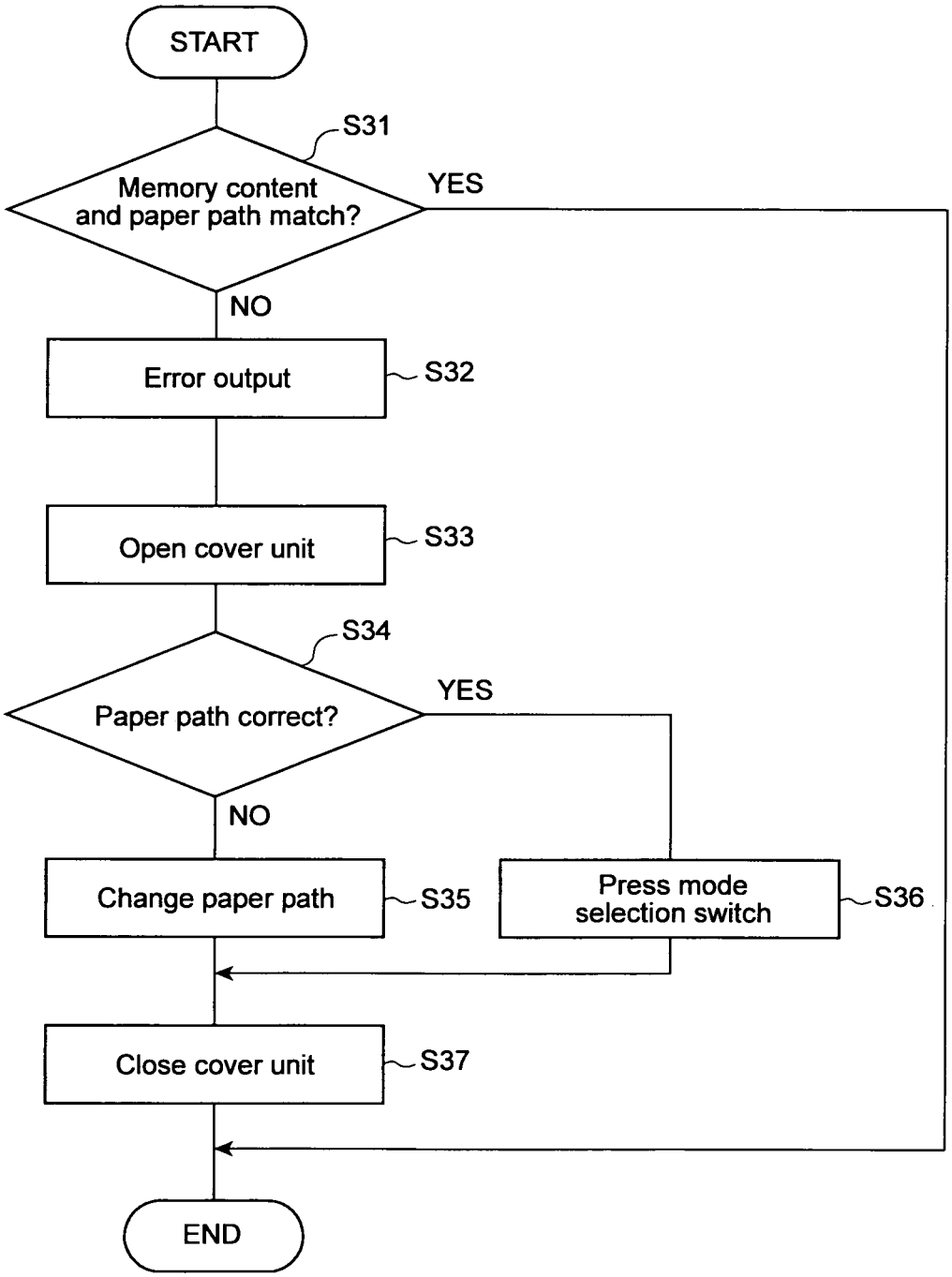
FIG. 8 is a flow chart of an error handling process.

FIG. 1 to FIG. 3 are oblique external views showing a label printer according to a first embodiment of the invention. FIG. 4 is a schematic section view and block diagram of the label printer shown in FIG. 3. FIG. 5 is a section view of the label printer when the mode selection switch shown in FIG. 4 is a slide switch. FIG. 6 is a block diagram of the control system of the label printer according to a first embodiment of the invention. FIG. 7 is a flow chart of (a) the paper loading process, and (b) a process for changing the printer configuration. FIG. 8 is a flow chart of an error handling process.

As shown in FIG. 1 to FIG. 3, a label printer 1 according to a first embodiment of the present invention has a cover unit 2 assembled on the front of the printer housing 7 so that the cover unit 2 can open up the front of the printer housing 7. A power switch 3, cover opening switch 4, and feed switch (label feed switch) 5 are positioned on the surface of the printer housing 7. A display unit 6 with paper out, error, and power indicators (LEDs) is also provided so that the operating status of the label printer 1 can be determined.

The cover unit 2 is composed of a printer cover 25 and a peeling unit (label-peeling mechanism) 21.

The peeling unit 21 is axially supported so that the peeling unit 21 can pivot at the top edge of the printer cover 25. As shown in FIG. 1, the peeling unit 21 can be pulled out to the front from the printer cover 25.

When in the peeling configuration (peeling mode) with the web 9 of the label paper 11 passing through the second paper transportation path B (FIG. 4), the label paper 11 is pulled out as shown in FIG. 1 and only the web 9 part of the label paper 11 is fed through a specific path as shown in FIG. 2. The peeling unit 21 is then closed as shown in FIG. 3 so that the labels 8 and web 9 are discharged from separate paths.

When in the label configuration (non-peeling mode), the label paper 11 is inserted into a first paper transportation path A (FIG. 4), and the labels 8 are discharged from the label dispensing opening 10 while still affixed to the web 9.

The label paper 11 can thus be handled by opening the cover unit 2. More particularly, opening the peeling unit 21 enables loading the label paper 11 into the desired paper transportation path, and opening the printer cover 25 enables replacing the roll of label paper 11.

FIG. 4 is a block diagram and schematic section view showing the internal configuration of the label printer.

A roll paper compartment 12 is formed inside the printer housing 7. This roll paper compartment 12 is a label paper compartment and holds label paper 11 wound in a roll. The leading end of the label paper 11 is pulled from the roll paper compartment 12 by rollers 13 for conveying the label paper 11 to the printing unit 37 (FIG. 6), and printed by the printing mechanism 14.

When in the label configuration, the label paper 11 is discharged from the label-dispensing opening 10 (first paper transportation path A). When in the peeling configuration, the label paper 11 is curled by the label-peeling unit 15, thus separating the web 9 from the labels 8. The web 9 is thus discharged past the paper detector 17 and from the web exit 16 (second paper transportation path B). The peeled labels 8 are discharged from the label-dispensing opening 10.

Opening the printer cover 25 also exposes a mode selection switch 19. An operator cannot physically access the mode selection switch 19 unless the printer cover 25 is open.

The mode selection switch 19 is a pushbutton switch in this embodiment of the invention, but could be a slide switch 191 as shown in FIG. 5.

Pressing the mode selection switch 19 sends a mode selection signal to the control unit 26 and changes the current printing configuration (label dispensing mode) to a different printing configuration. When the cover open detection unit 18 detects that the cover unit 2, and more particularly the printer cover 25, is open, and outputs a cover-open signal to the control unit 26, the control unit 26 determines that the label printer 1 is off-line and enables selection signal input from the mode selection switch 19.

After the mode selection switch 19 outputs the mode selection signal in the off-line mode and the printing configuration is changed, the mode selection signal is disabled.

The switch can thus be operated only once each time the cover is opened, and pressing (activation of) the switch once causes the printing configuration selection unit (dispensing mode selection unit) 27 to change the printing configuration. The switch is then reset when the cover is closed and the cover open detection unit 18 inputs a cover-closed signal, thus enabling subsequent activation of the switch when the cover is reopened.

Note that the invention could also be arranged to change the printing configuration each time the mode selection switch 19 is operated instead of enabling the switch only once each time the cover is opened. In this arrangement an LED in the display unit 6 could be turned on or off to indicate the selected printing configuration.

A slide switch 191 as shown in FIG. 5 can also be used as the dispensing-mode selection switch. The position of this slide switch 191 is detected by the printing configuration selection unit 27 of the control unit 26, and the slide switch 191 can thus be positioned to select a particular desired printing configuration.

A window 24 is preferably positioned on the printer cover 25 portion of the cover unit 2 so that the slide switch 191 can be seen. This enables visual confirmation of the position of the slide switch 191 and thus the printing configuration selected for the label printer.

This slide switch 191 is also accessible only when the cover unit 2 is open and the label printer 1 is off-line. Operating the slide switch 191 thus sends a mode selection signal to the control unit 26, and the current printing configuration is changed to another printing configuration.

A label printer 1 according to this embodiment of the invention is thus composed of an input system (paper detector 17, cover open detection unit 18, mode selection switch 19, 191), the control unit 26, and an output system (display unit 6, rollers 13, printing mechanism 14) with the control unit 26 controlling overall operation of the label printer.

Opening the cover unit 2 to replace the label paper 11 causes the cover open detection unit 18 to detect that the cover is open and the label printer 1 to go off-line, and causes the control unit 26 to stop the paper feed and printing operations and enter a pause mode.

The label paper 11 is then inserted into the first paper transportation path A or the second paper transportation path B. Closing the cover unit 2 then cancels the pause mode.

If the web 9 of the label paper 11 is fed through the second paper transportation path B and the peeling mode is thus set, the paper detector 17 detects the presence of the web 9 and the control unit 26 thus controls the paper transportation and printing operations in the peeling mode.

If the label paper 11 is loaded to the first paper transportation path A, the paper detector 17 does not detect the web 9 and the control unit 26 thus controls the paper transportation and printing operations in the non-peeling mode.

The printing configuration can be changed while the label printer 1 is operating by pressing the mode selection switch 19. Furthermore, the mode selection switch 19 cannot be physically accessed unless the cover unit 2 is opened because the mode selection switch 19 is inside the printer housing 7. Locating the mode selection switch 19 inside the cover unit 2 prevents mistakenly pressing or moving the switch while the printer is operating.

The label printer 1 also has a communication interface 28. The communication interface 28 enables managing the control unit 26 using one or more control signals received from an external host computer, and the paper transportation and printing operations can be controlled by such control signals.

A display unit 6 positioned on the surface of the printer housing 7 is driven by the control unit 26 to indicate whether label paper 11 is loaded and whether the printer is turned on, and to display errors. The error indicator is driven to indicate an error if, for example, the host computer 29 asserts a command in the non-peeling mode but the label paper 11 is inserted in the transportation path for the peeling mode (that is, second paper transportation path B).

FIG. 6 is a block diagram of the control system of the label printer 1.

The controller or CPU 30 runs various processes by communicating with other parts over the bus 31. ROM 32 and RAM 33 are also connected to the bus 31. Information about changes to the printing configuration (dispensing mode changes) is temporarily stored in RAM 33 and read therefrom by the CPU 30 to control other processing units.

Also connected to the bus 31 and controlled by the CPU 30 are a motor driver 34 and printer driver 36, sensor circuit 38, and switch circuit 40. The motor driver 34 and printer driver 36 cause the rollers 13 and printing mechanism to operate according to the selected printing configuration. The sensor circuit 38 receives information that indicates whether paper is loaded. The switch circuit 40 functions to stop or drive the paper transportation and printing operations based on whether the power is turned on, a change in the printing configuration, and opening and closing the covers. The display unit 6 presents status information and is controlled by the CPU 30 to turn on or off.

An external device can also be connected through the communication interface 28, thus enabling memory access and remotely controlling the label printer 1.

FIG. 7 (*a*) is a flow chart of the paper loading operation. The cover unit 2 is opened while the label printer 1 is running (S1) and label paper 11 is loaded into the roll paper compartment 12. Because there is no need to change the printing configuration at this time, the cover unit 2 is closed without pressing the mode selection switch 19, and operation using the previous printing configuration resumes (S3).

FIG. 7 (*b*) is a flow chart of a process for changing the printing configuration while the printer is operating.

To change the printing configuration the cover unit 2 is first opened (S11). The mode selection switch 19 is pressed while the cover unit 2 is open to change the printing configuration (S12). If the printer is set to the peeling mode before the mode selection switch 19 is pressed (S13 returns yes), the printing configuration information (label dispensing mode information) stored in RAM 33 is changed from the peeling mode to the non-peeling mode (S14).

The label paper 11 is then changed (re-routed) from the second paper transportation path B used in the peeling mode to the first paper transportation path A used in the non-peeling mode (S15).

If the printer is not set to the peeling mode before the mode selection switch 19 is pressed (S13 returns no), the printing configuration information (label dispensing mode information) stored in RAM 33 is changed from the non-peeling mode to the peeling mode (S16). The web 9 of the label paper 11 is then moved (re-routed) from the first paper transportation path A for the non-peeling mode to the second paper transportation path B used in the peeling mode (S17).

Closing the cover unit 2 after this task is completed (S18) enables printing to proceed using the changed printing configuration.

If the mode selection switch 19 is not pressed in step S12 the printing configuration is not changed and printing resumes in the same mode after the cover unit 2 is closed again.

FIG. 8 is a flow chart of an error handling process for when the label paper is not loaded into the transportation path that matches the printing configuration selection unit setting.

The control unit uses a memory switch as the printing configuration selection unit and an initial printing configuration can be set with this memory switch. The printing configuration thus written into memory and the transportation path through which the label paper 11 is actually loaded are compared (S31). If the printing configuration and the transportation path do not match (S31 returns no), an error is indicated on the display unit 6 (S32). The cover unit 2 can then be opened (S33), the paper re-routed into the correct transportation path (S34 and S35), and the cover unit 2 closed again (S37). Operation then resumes.

If the label paper 11 is loaded correctly, the selected printing configuration can be changed in the printing configuration selection unit by opening the cover unit 2 and pressing the mode selection switch 19 (S36). This rewrites the content of the memory switch. The cover unit 2 is then closed (S37) to resume operation. Note that the memory switch setting is changed only once even if the mode selection switch 19 is pressed multiple times while the cover unit 2 is open.

Closing the cover unit 2 saves the printing configuration and writes the printing configuration selection to the memory switch. If changing the initial setting is not desirable, writing the printing configuration to the memory switch is not necessary.

Displaying configuration errors thus enables the operator to easily and quickly recognize and correct the problem. Label waste can thus be reduced.

Figure 9:
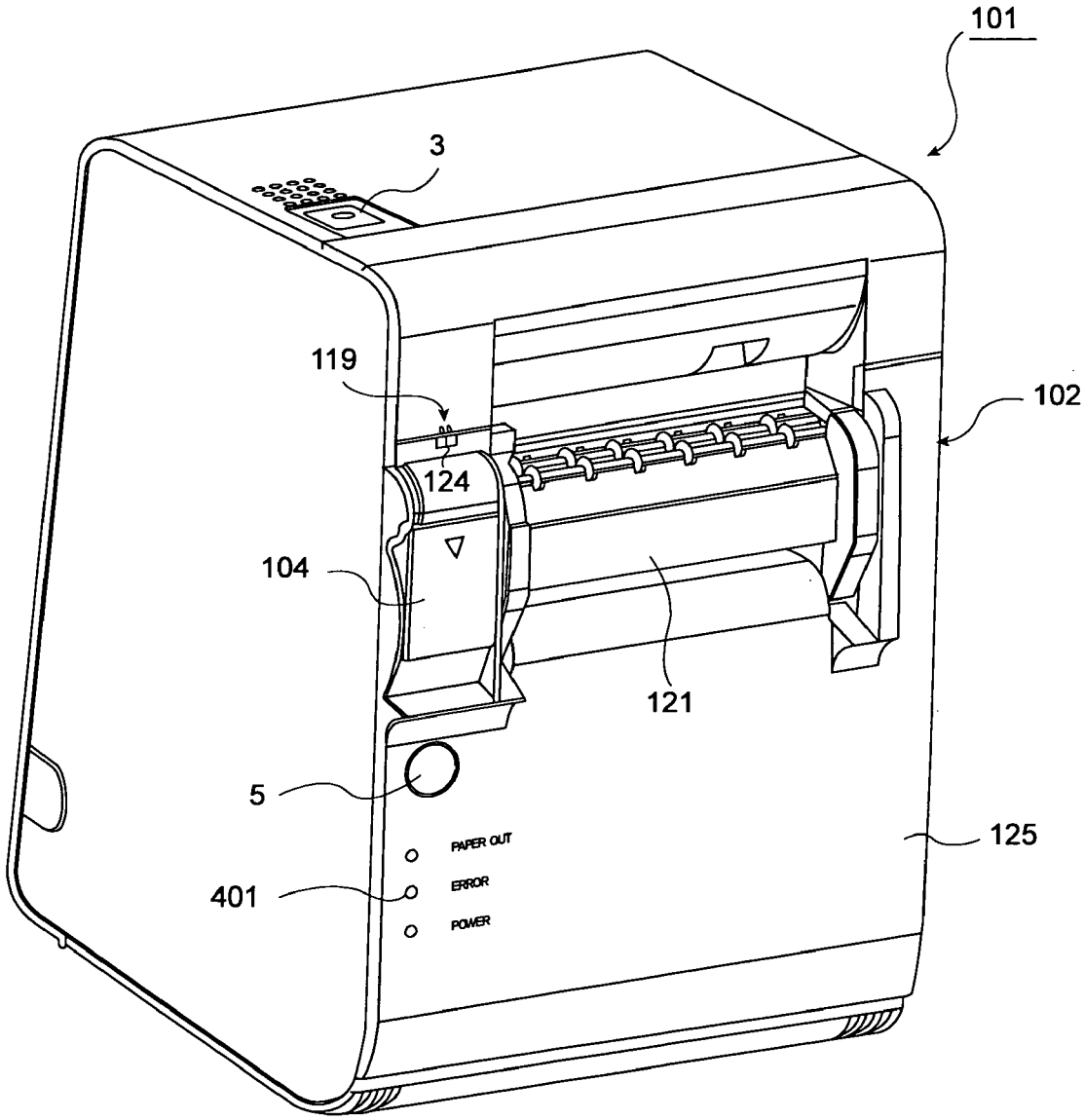
FIG. 9 is an oblique external view of a label printer according to a second embodiment of the present invention.
Figure 10:
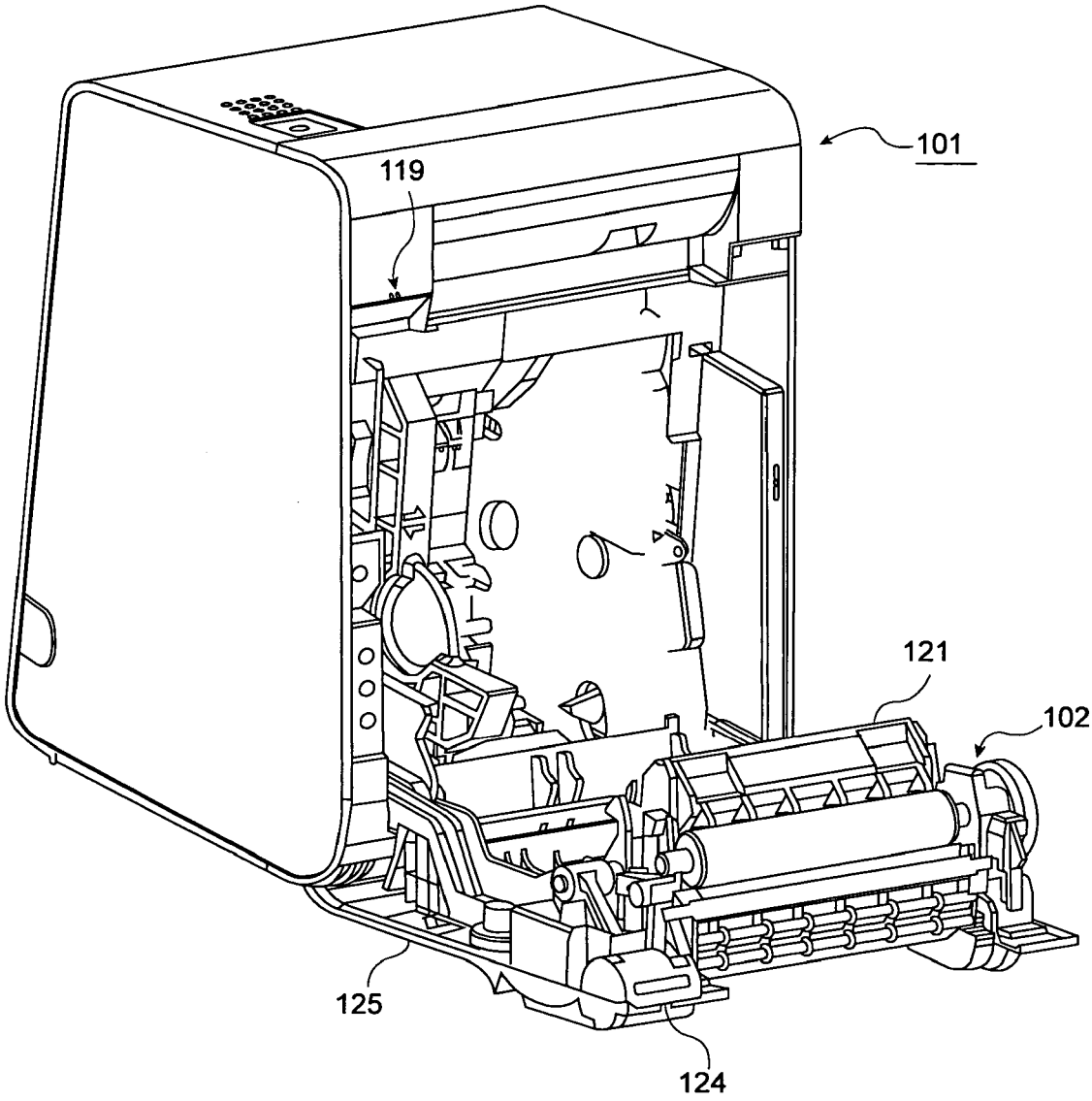
FIG. 10 is an oblique external view of the label printer shown in FIG. 9 with the cover unit open.

FIG. 9 shows a label printer 101 according to a second embodiment of the present invention. Like parts in this label printer 101 and the label printer 1 in the foregoing first embodiment of the invention are identified by like reference numerals, and further description thereof is omitted below.

A label printer 101 according to this second embodiment of the invention uses a slide switch 119 as the mode selection switch.

A window 124 is formed in the top of the printer cover 125 portion of the cover unit 102 so that the position of the slide switch 119 can be viewed through the window 124 when the cover unit 102 is closed. In addition, the slide switch 119 cannot be physically accessed when the cover unit 102 is closed.

The printer cover 125 can be opened after opening the peeling unit 121 in a label printer 101 according to this second embodiment of the invention. Opening the printer cover 125 also causes the label printer 101 to go off-line.

This label printer 101 is controlled in the same way as the label printer 1 according to the foregoing first embodiment of the invention.

Figure 11:
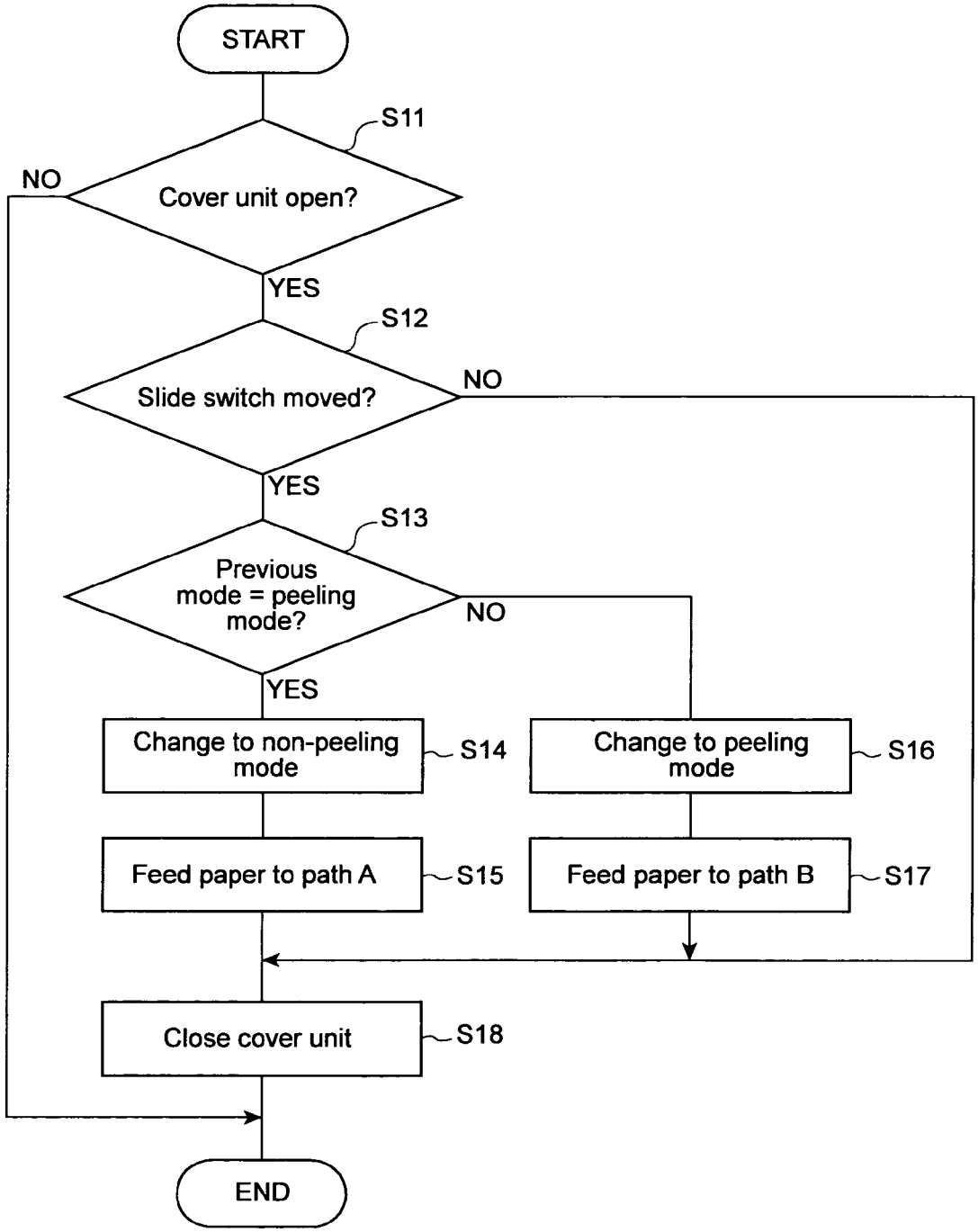
FIG. 11 is a flow chart of a process for changing the printing configuration using the slide switch.

FIG. 11 is a flow chart of a process for changing the printing configuration by means of the slide switch 119. Like steps in FIG. 11 and the flow chart in FIG. 7 (*b*) are identified by the same reference numerals, and further description thereof is omitted below.

The printing configuration is determined from the position of the slide switch 119 in the process shown in FIG. 8. The current printing configuration setting can be visually confirmed by using a slide switch 119 (S22).

Figure 16:
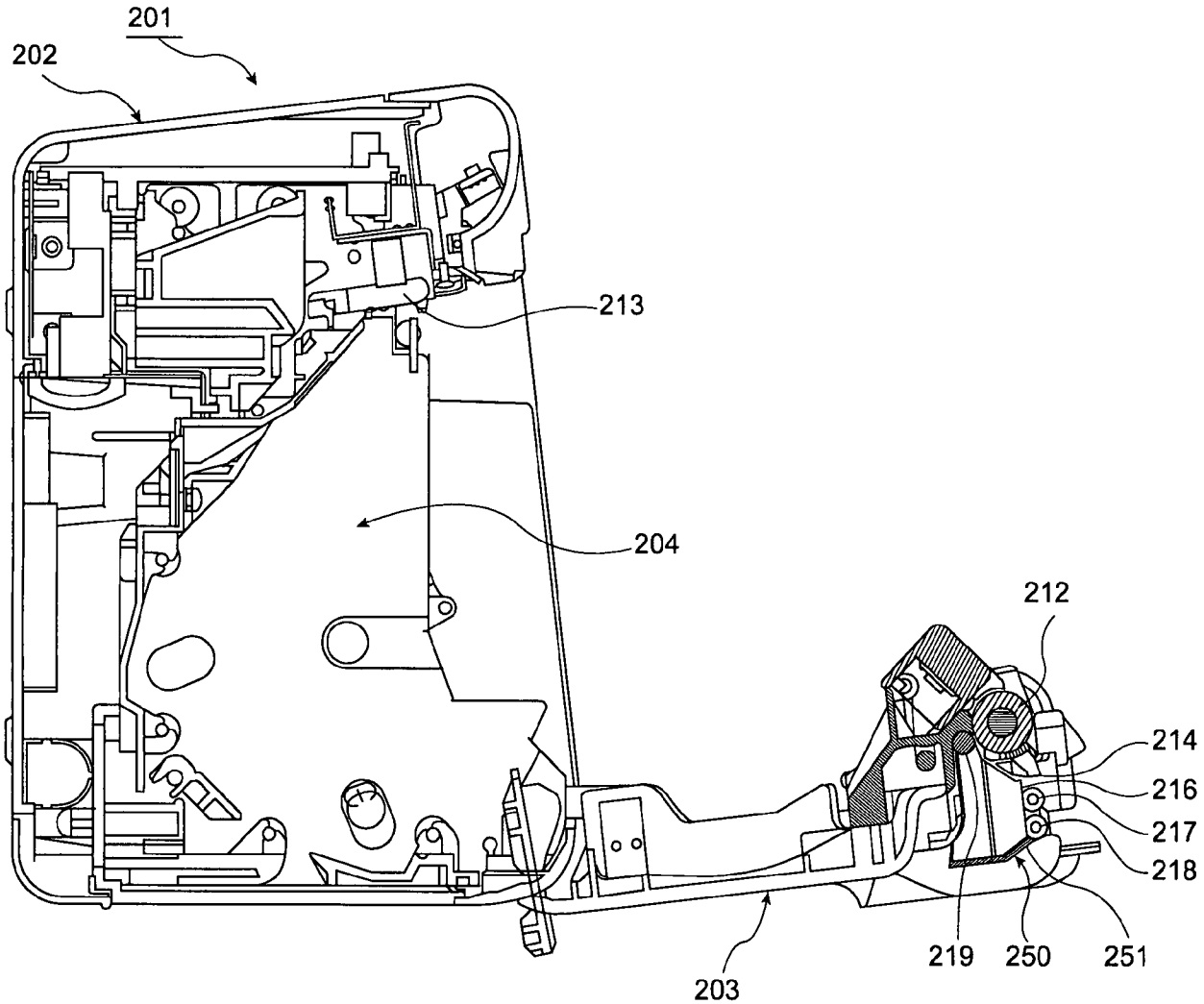
FIG. 16 is a side section view of the label printer shown in FIG. 15.
Figure 17:
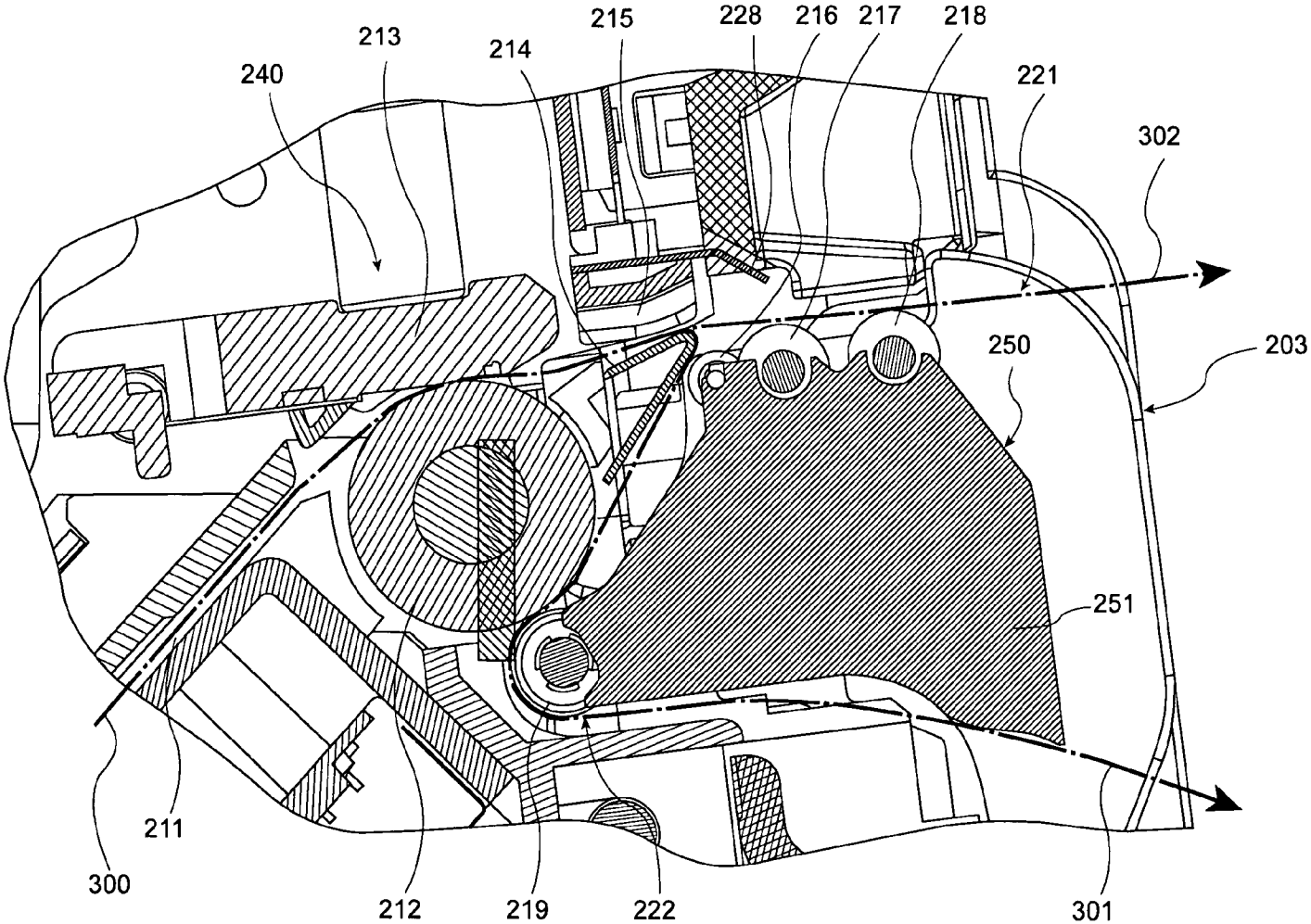
FIG. 17 is a side section view showing the major internal arrangement of the label printer shown in FIG. 12.
Figure 21:
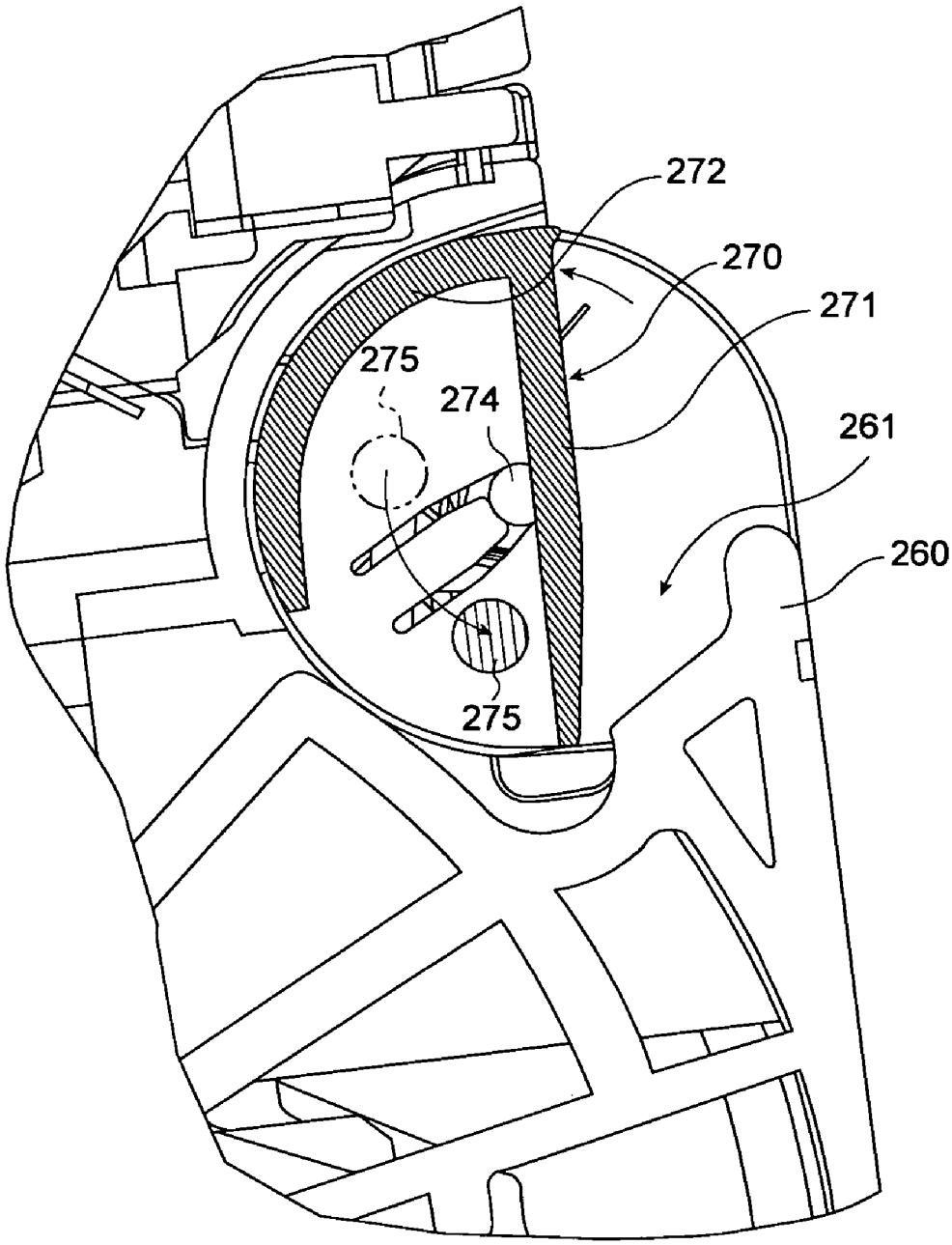
FIG. 21 is a side section view showing the relationship between the shutter and the printer cover release lever when the peeling unit release lever is operated in the label printer shown in FIG. 12.
Figure 22:
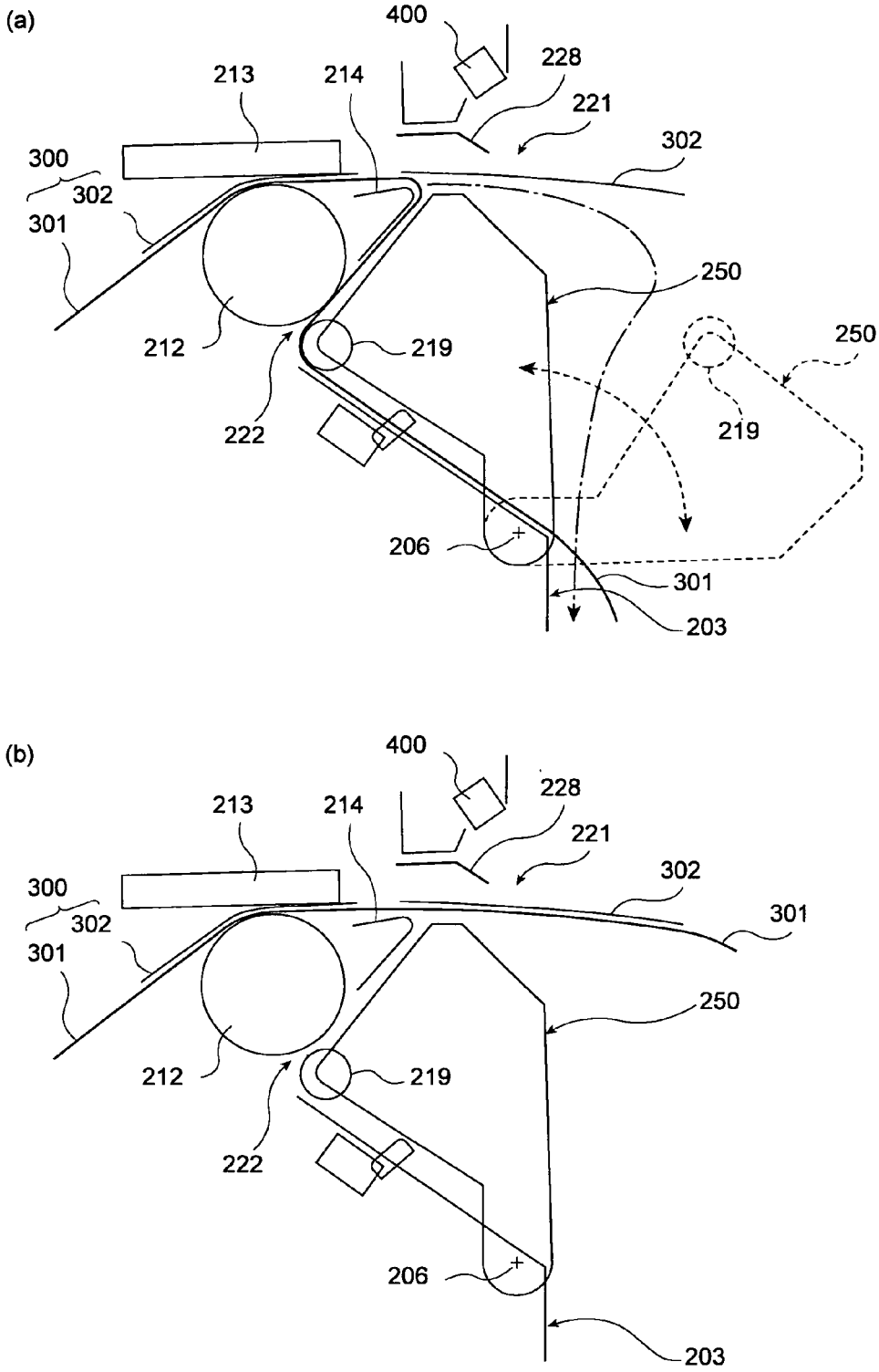
FIG. 22 illustrates the differences between the web transportation paths in the different label dispensing modes, (a) showing the web transportation path in the peeling mode, and (b) showing the web transportation path in the non-peeling mode.

FIG. 12 to FIG. 15 are external oblique views of a label printer according to a third embodiment of the invention. FIG. 16 and FIG. 17 are side section views showing the major internal arrangement of the label printer. FIG. 18 to FIG. 21 are side section views showing the relationship between the shutter and the printer cover release lever when the peeling unit release lever is operated. FIG. 22 describes the differences between the web transportation paths in the different label dispensing modes.

As shown in FIG. 12 to FIG. 16, a label printer 201 according to this third embodiment of the invention has a long box-like printer housing 202. A printer cover 203 (cover unit) is attached to the front of the printer housing 202 so that the printer cover 203 can be freely opened and closed. Opening the printer cover 203 opens the roll paper compartment 204, that is, the label paper compartment, inside the printer housing 202 so that label paper 300 can be loaded into the printer.

The printer cover 203 is more particularly connected to the bottom of the printer housing 202 by a rotating shaft 205, thus enabling the printer cover 203 to pivot freely open and closed. A label-dispensing slot 208 is formed in the top of the printer cover 203, and a web discharge slot 207 is formed below the label-dispensing slot 208.

A printing mechanism 240 for printing labels 302 while conveying label paper 300 having a plurality of labels 302 peelably affixed to a long rolled web 301 (see FIG. 15) is positioned inside the case (composed of the printer housing 202 and printer cover 203) as shown in FIG. 17.

The printing mechanism 240 in this embodiment of the invention has a thermal print head 213 and a platen roller 212. The thermal print head 213 is a print head that is positioned in the printer housing 202 opposite the label paper 300. The platen roller 212 is positioned to press the label paper 300 against the thermal print head 213.

A roll of label paper 209 is loaded into the roll paper compartment 204 formed in the lower portion inside the printer housing 202. This roll of label paper 209 is the label paper 300 wound into a roll. The label paper 300 is a long web 301 of a constant width with a plurality of typically rectangular labels 302 affixed to the web 301.

A peeling unit (label peeling mechanism) 250 is positioned in the top end portion of the printer cover 203 in this embodiment of the invention. The peeling unit 250 is connected by intervening pivot pins 206 (see FIG. 15) at the bottom end portion thereof to the printer cover 203 so that the peeling unit 250 can swing freely. A label-dispensing slot 208 is formed between the top edge of the peeling unit 250 and the upper wall of the printer housing 202. The web discharge slot 207 is formed between the printer cover 203 and the bottom end of the peeling unit 250. A web cutter 227 is positioned in the web discharge slot 207, and a peeled label detector 400 and manual cutter 228 are positioned in the label dispensing slot 208.

The peeling unit 250 conveys the printed label paper 300 acutely around a web-bending guide 214 with the back of the web pressed against the web-bending guide 214, thereby separating the labels 302 from the web 301 being conveyed through a curved path.

The peeling unit 250 forms a label-guiding path 221 (first paper transportation path) and a web-guiding path 222 (second paper transportation path).

Figure 12:
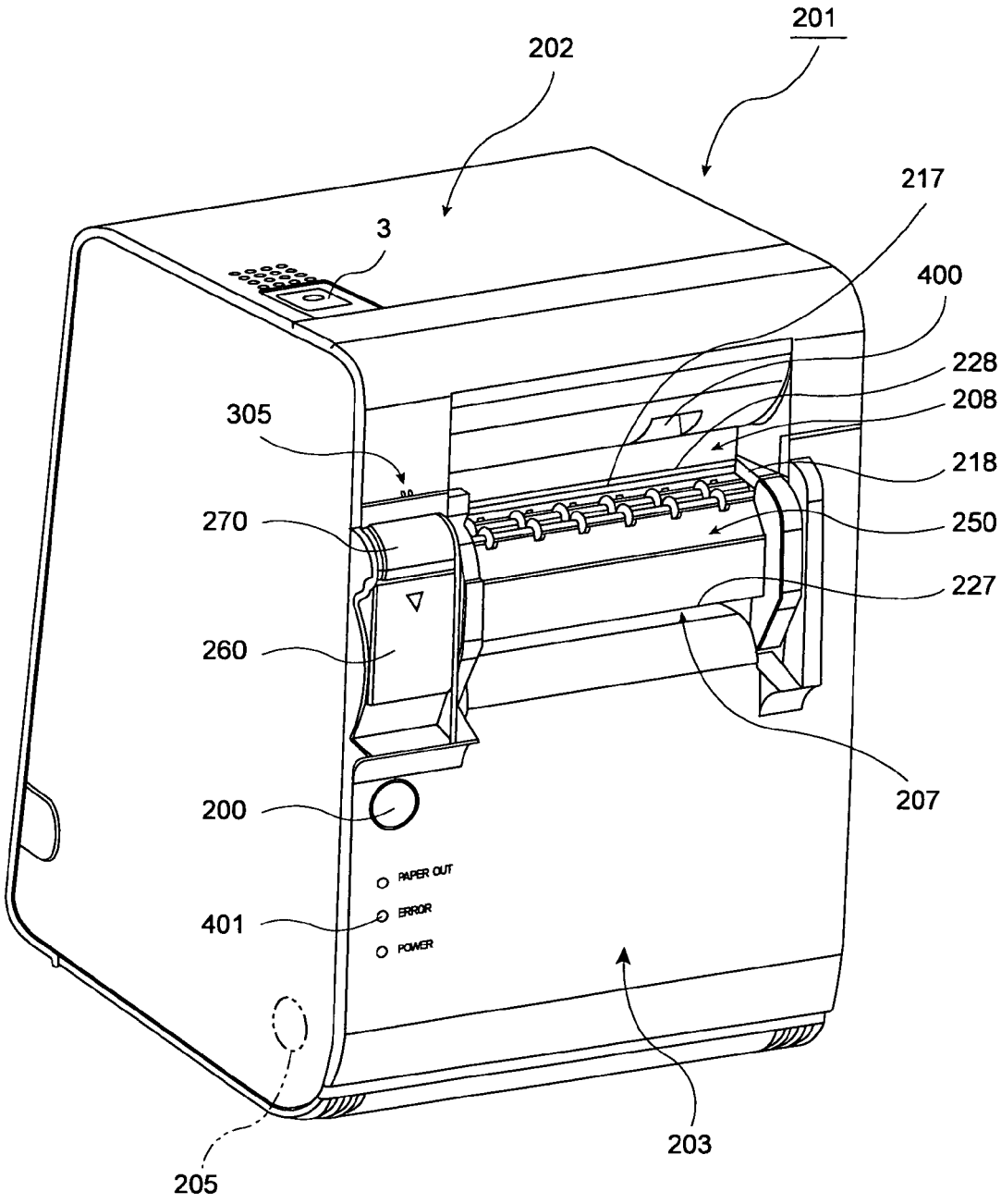
FIG. 12 is an oblique external view of a label printer according to a third embodiment of the invention when the printer cover and peeling unit are closed.

When the peeling unit 250 is closed to a specific position, the label-guiding path 221 guides the labels 302 peeled from the web 301 to the label dispensing slot 208 (see FIG. 12). The web-guiding path 222 guides the label paper 300 pressed against the web-bending guide 214 and discharges the web 301 from which the labels 302 have been peeled from the label dispensing slot 208 (see FIG. 12).

When the peeling unit 250 is open, both the label-guiding path 221 and web-guiding path 222 are open and externally exposed.

Referring still to FIG. 17, a web pressure roller 216, label transportation roller 217, label guide roller 218, and peeling roller 219 are positioned freely rotationally on the housing 251 of the peeling unit 250 in order to form the label-guiding path 221 and web-guiding path 222.

The peeling roller 219 presses against the platen roller 212 with the web 301 therebetween, thus rotates following the rotation of the platen roller 212, and works with the platen roller 212 to convey the web 301 along the web-guiding path 222.

The peeling unit 250 is held in the closed position by the peeling roller 219, which is engaged with the path of roller rotation intersecting the outside surface of the platen roller 212.

The web pressure roller 216 is positioned proximally to the downstream-side guide surface of the web-bending guide 214, and thus rotates while applying pressure to the web 301.

The label transportation roller 217 is positioned freely rotationally proximally to the downstream-side guide surface of the web-bending guide 214. Rotation of the peeling roller 219 is transferred to the label transportation roller 217 through a gear train or other drive transfer mechanism not shown, and conveys the labels 302 separated from the web 301.

The label guide roller 218 is positioned freely rotationally near the label dispensing slot 208 side of the label transportation roller 217 at substantially the same elevation, and supports the peeled labels 302. The peeled labels 302 are detected by the peeled label detector 400.

Ribs 215 are positioned above and opposite the web-bending guide 214 to press the labels 302 and web 301 down from above. A manual cutter 228 for cutting the web 301 as needed is positioned above the label transportation roller 217.

Ribs 220 forming part of the web-guiding path 222 are also positioned on the housing 251 between the peeling roller 219 and web pressure roller 216. The ribs 215 and ribs 220 reduce the contact area with the labels 302 and web 301, and thus reduce the adhesion of adhesive from the labels.

When the platen roller 212 is in a specific position, the thermal print head 213 and platen roller 212 are on opposite sides of the transportation path 211 of the label paper 300, and the platen roller 212 presses the label paper 300 against the thermal print head 213 while conveying the paper to the downstream side.

The platen roller 212 and web-bending guide 214 are positioned on the printer cover 203, and opening the printer cover 203 thus opens the transportation path 211.

A label printer 201 according to this third embodiment of the invention can select either of two label dispensing modes: a peeling mode (peeling configuration) and a non-peeling mode (continuous label configuration).

In the peeling mode as shown in FIG. 22 (*a*), the printed labels 302 are peeled from the web 301, and the labels 302 and web 301 are respectively discharged from the label dispensing slot 208 and web discharge slot 207 of the label-guiding path 221 and the web-guiding path 222.

In the non-peeling mode as shown in FIG. 22 (*b*), the web 301 is conveyed through the label-guiding path 221 and discharged from the label dispensing slot 208 without the printed labels 302 being peeled from the web 301.

These modes are mechanically configured by opening the label-guiding path 221 and web-guiding path 222 and changing the path to which the web 301 is loaded.

As shown in FIG. 12, a printer cover release lever 260 for opening the printer cover 203 is positioned at the side of the printer cover 203. This printer cover release lever 260 is linked to a rocker arm 263 shown in FIG. 15. When the operator pulls forward on the top of the printer cover release lever 260 with a finger, the rocker arm 263 rotates and disengages an engaging portion (not shown) inside the printer housing 202, thus allowing the printer cover 203 to open. When the printer cover 203 closes, the rocker arm 263 automatically engages this engaging portion inside the printer housing 202 and thus locks.

Figure 19:
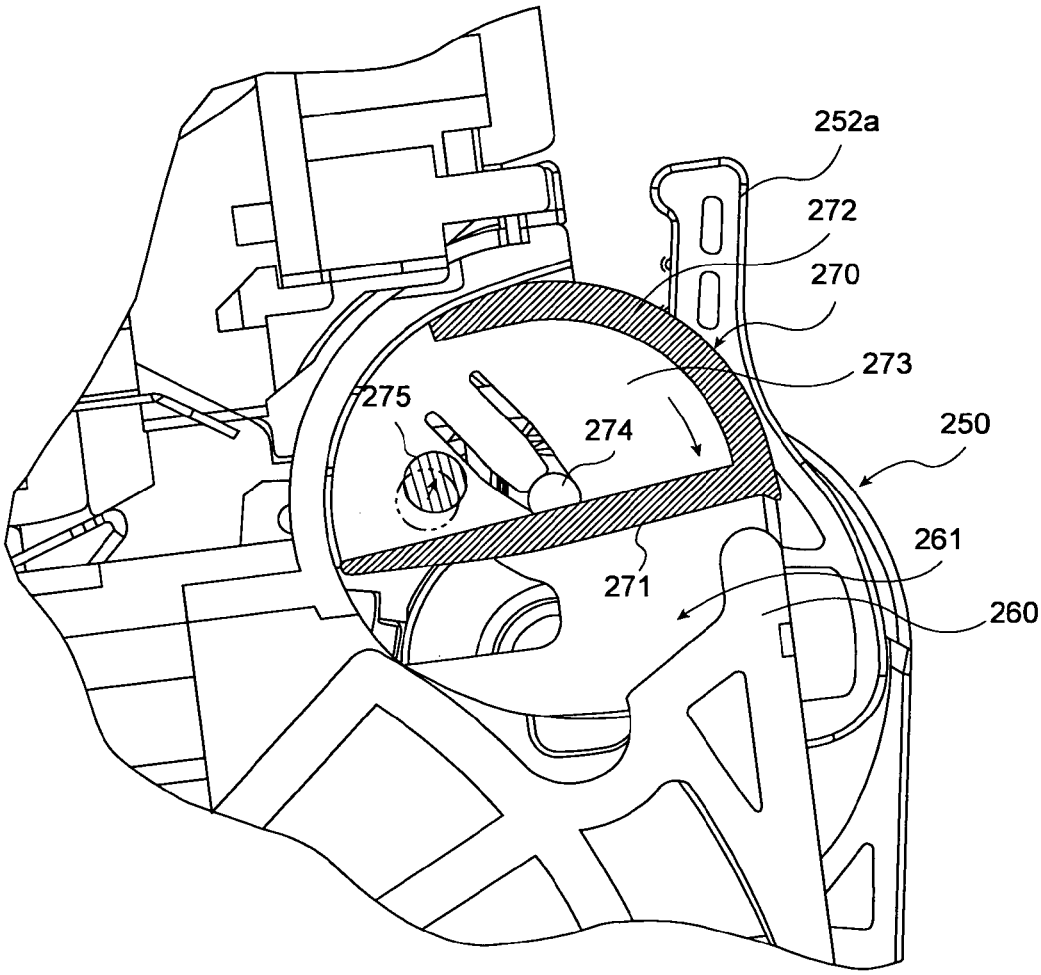
FIG. 19 is a side section view showing the relationship between the shutter and the printer cover release lever when the peeling unit release lever is operated in the label printer shown in FIG. 12.

A recessed portion 261 for grasping the top edge of the printer cover release lever 260 is positioned on the back at the top of the printer cover release lever 260 as shown in FIG. 19. A shutter 270 (operation control mechanism) is also positioned on the recessed portion 261 to prevent the operator from accidentally hooking the recessed portion 261 with a finger.

Figure 13:
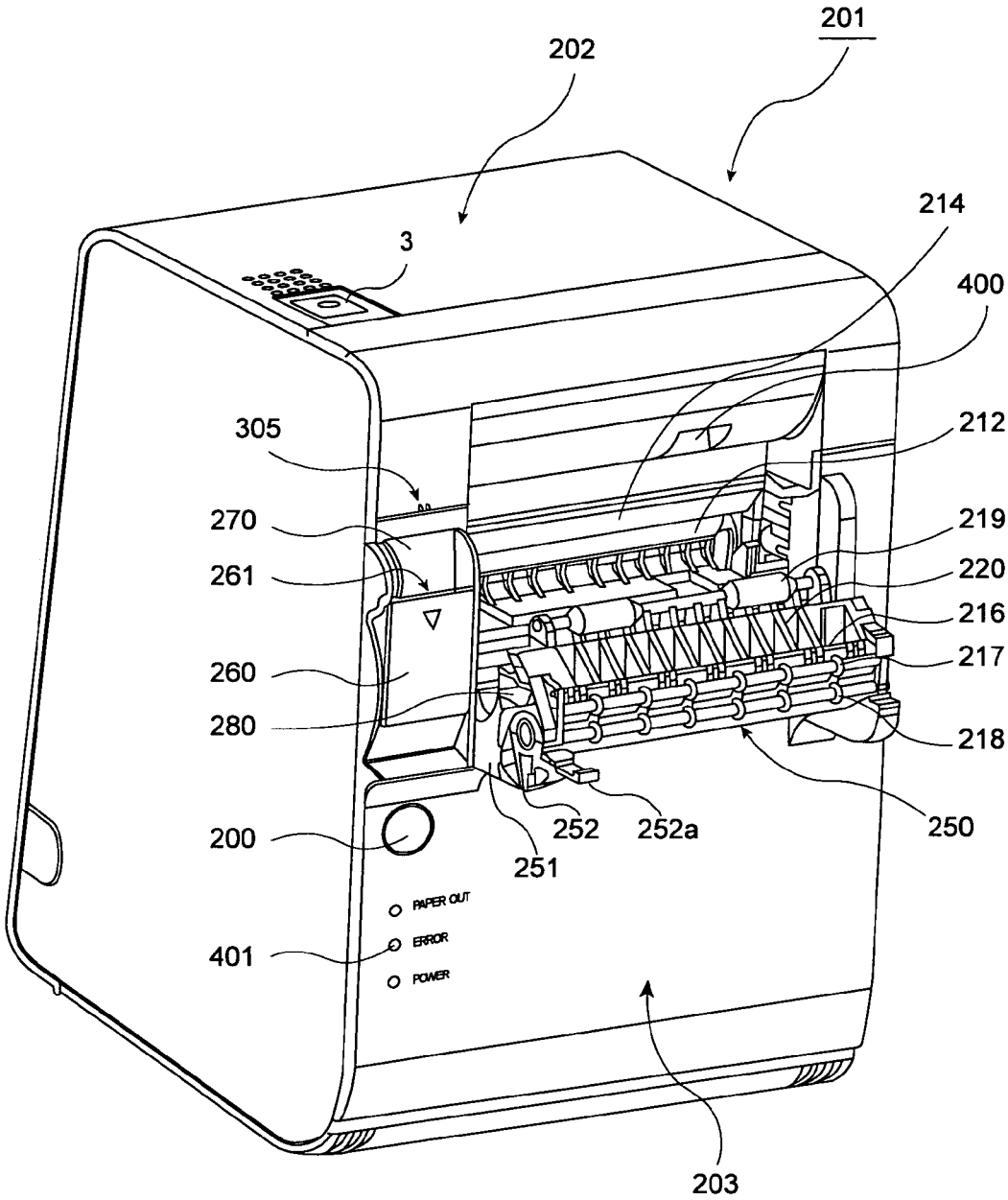
FIG. 13 is an oblique external view of the label printer shown in FIG. 12 when the peeling unit is open.

The shutter 270 can pivot between a position closing the recessed portion 261 as shown in FIG. 12 and a position opening the recessed portion 261 as shown in FIG. 13, and is assembled to operate in conjunction with operating the peeling unit release lever 252 of the peeling unit 250.

Figure 18:
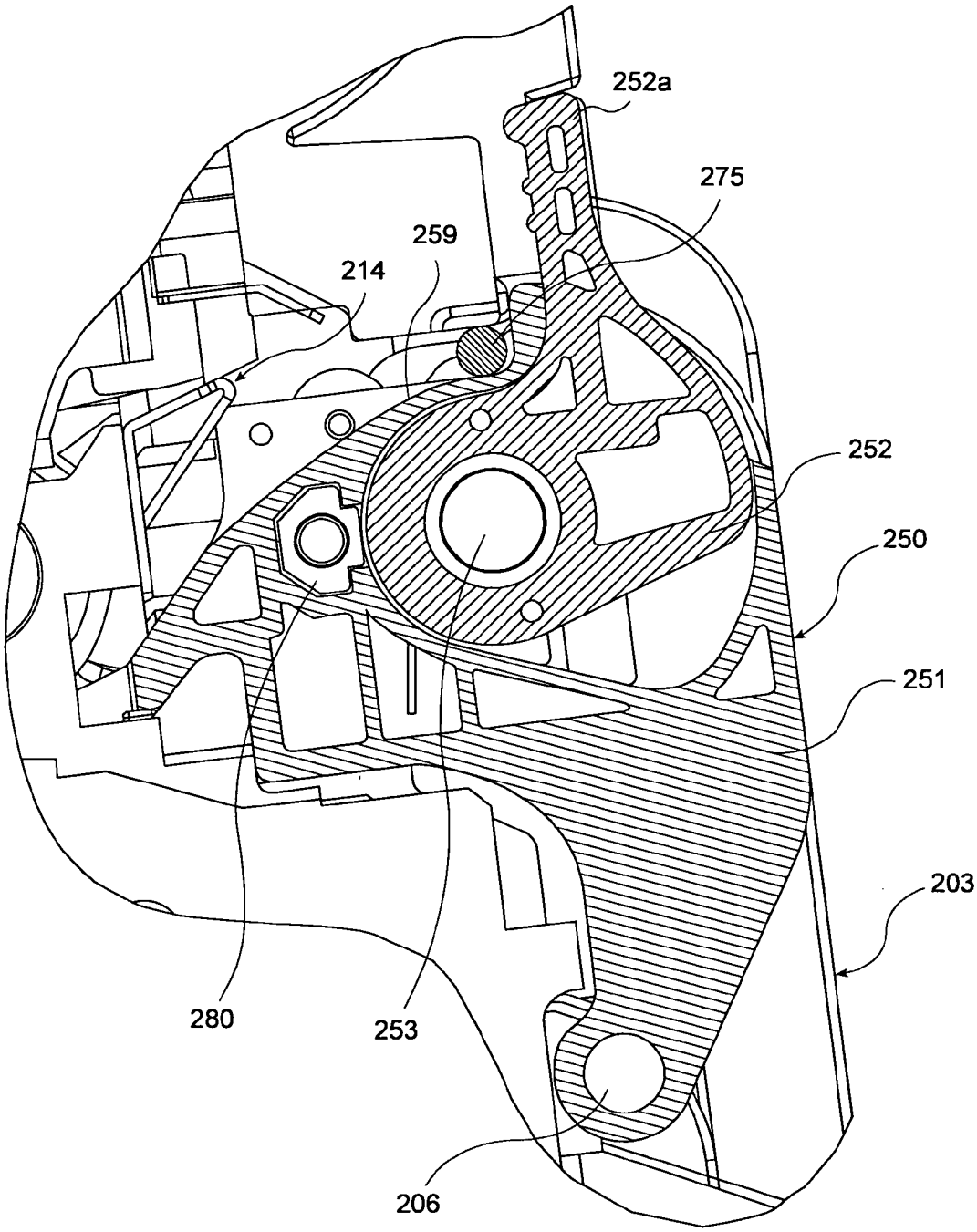
FIG. 18 is a side section view showing the relationship between the shutter and the printer cover release lever when the peeling unit release lever is operated in the label printer shown in FIG. 12.

As shown in FIG. 18, the peeling unit release lever 252 rotates on and is attached to the housing 251 of the peeling unit 250 by support shaft 253, and as shown in FIG. 13 is located beside the printer cover release lever 260 at the side of the peeling unit 250.

Figure 20:
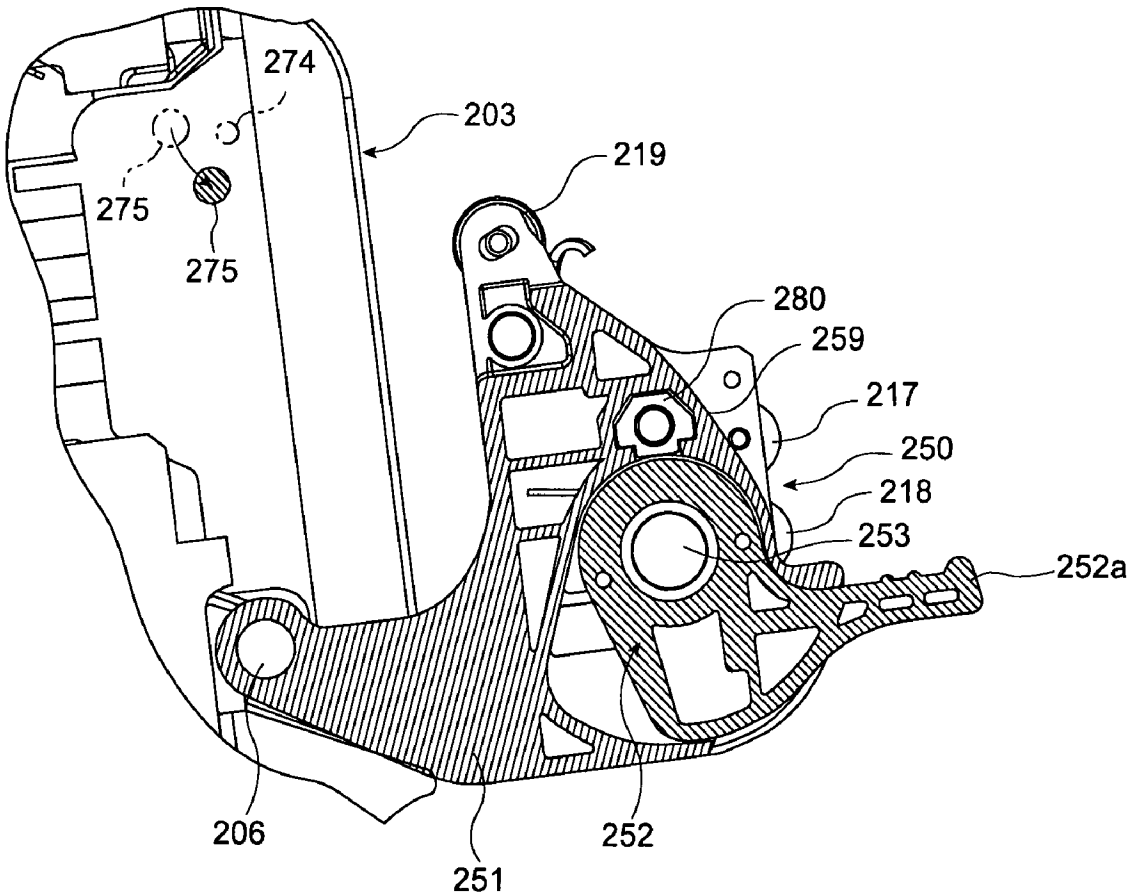
FIG. 20 is a side section view showing the relationship between the shutter and the printer cover release lever when the peeling unit release lever is operated in the label printer shown in FIG. 12.

As shown in FIG. 20, the peeling unit 250 can be opened by hooking a finger on the top end portion 252*a* of the peeling unit release lever 252 and pulling the lever 252 forward.

A locking unit (locking means) 280 is also positioned on the peeling unit 250 as shown in FIG. 13 for locking the peeling unit 250 closed to the printer cover 203. This locking unit 280 is linked to the peeling unit release lever 252 and thus operates in conjunction with rotation of the peeling unit release lever 252 to the peeling unit 250.

When the operator closes the peeling unit release lever 252, the locking unit 280 moves in the direction protruding to and engaging the engaging portion (not shown in the figure) inside the peeling unit 250 in conjunction with the direction of peeling unit release lever 252 rotation and thus locks.

When the peeling unit release lever 252 is opened, the locking unit 280 moves in the direction retracting inside the peeling unit in conjunction with the direction of peeling unit release lever 252 rotation, and thus unlocks the printer cover 203.

Because the peeling unit 250 can thus be reliably locked in the closed position, the peeling unit 250 will not open accidentally even if significant tension is applied to the peeling unit 250 such as when cutting the web 301 discharged from the label dispensing slot 208 or web discharge slot 207.

As shown in FIG. 19, the shutter 270 positioned in the recessed portion 261 on the back of the printer cover release lever 260 is a substantially semicircular tube of which the outside wall has a straight wall 271 aligned radially to the tube and a curved wall 272 continuously covering from the top edge of the printer cover release lever 260 to the entrance to the recessed portion 261. The shutter 270 moves circularly inside the recessed portion 261 on a shaft 274 disposed at the middle of the semicircular end walls 273. This shutter 270 moves circularly in the same plane of rotation as the printer cover release lever 260, and as shown in FIG. 21 is rotationally urged by a spring member (not shown in the figure) to a position opening the recessed portion 261.

Figure 14:
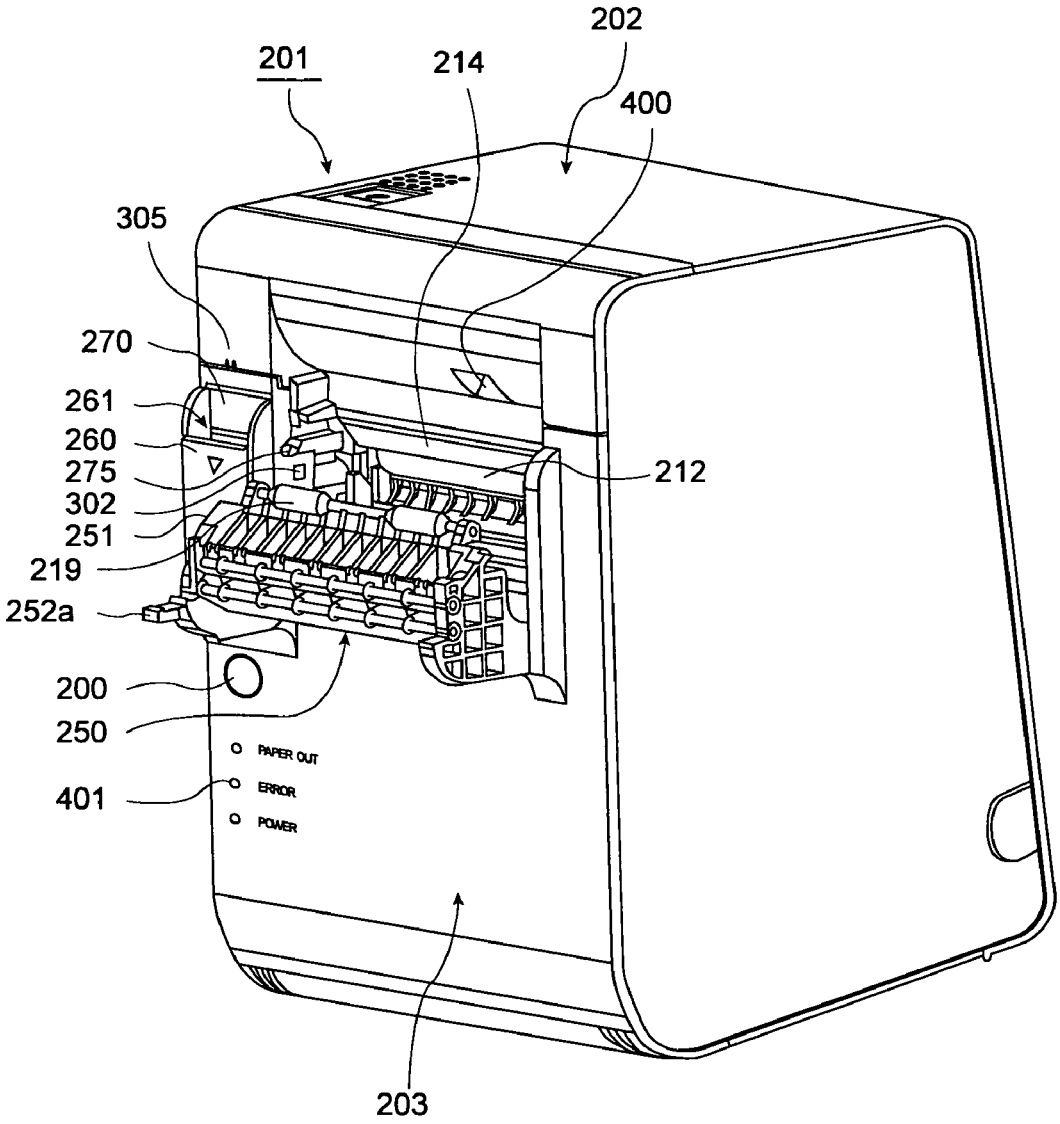
FIG. 14 is an oblique external view of the label printer shown in FIG. 13 from a different angle.
Figure 15:
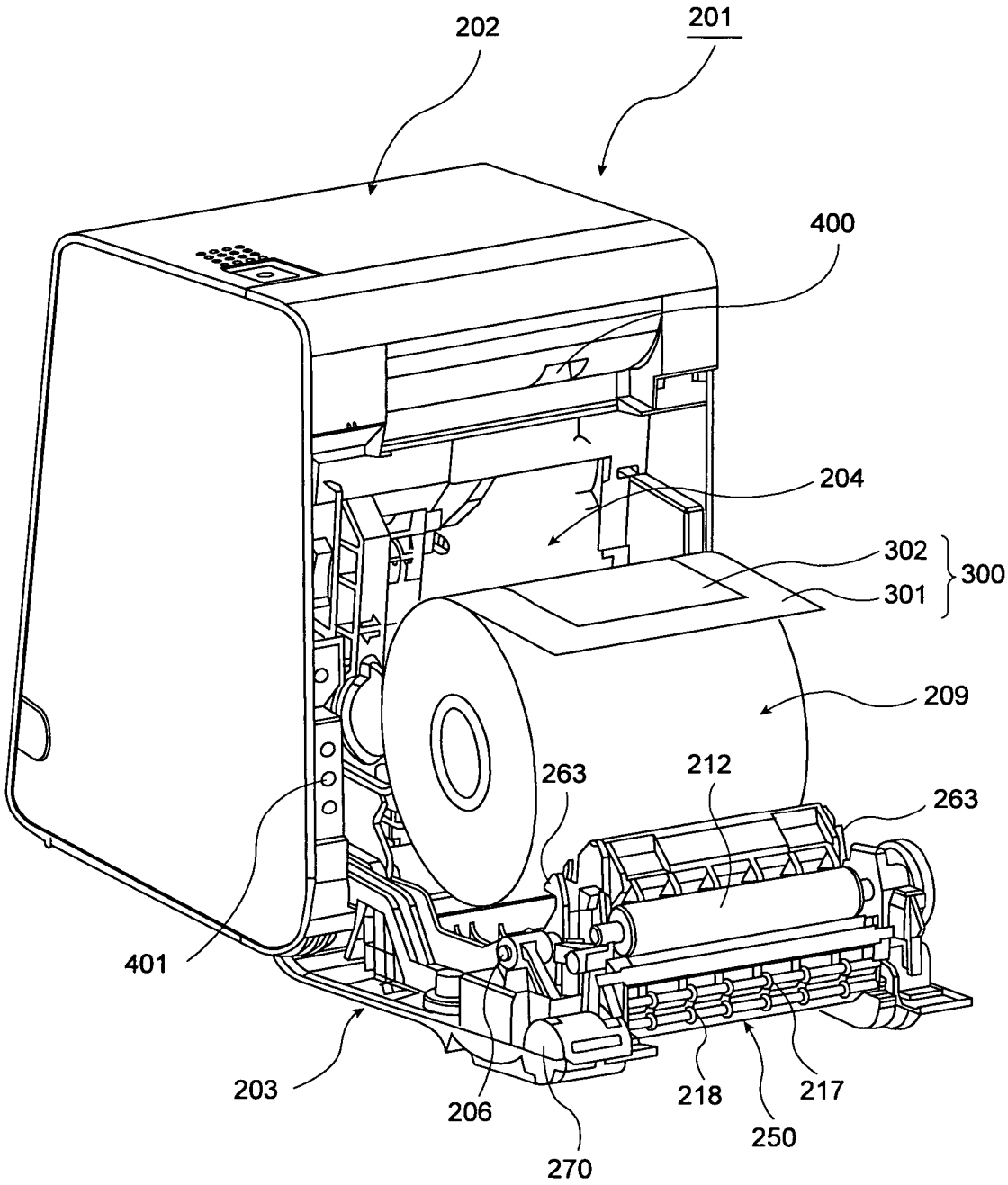
FIG. 15 is an oblique external view of the label printer shown in FIG. 12 when the printer cover is open.

A pin 275 protrudes from the outside surface of the end wall 273 of the shutter 270. As shown in FIG. 14, this pin 275 passes through a notch in the wall of the printer cover 203, is exposed inside the storage space (the opening in the printer cover 203) of the peeling unit 250 housing 251, and engages a cam surface 259 formed on the housing 251 of the peeling unit 250 (see FIG. 18).

When the peeling unit 250 is closed from the open position to the printer cover 203 and housed in the storage space, the cam surface 259 raises the pin 275 as shown in FIG. 18, the shutter 270 turns clockwise as seen in FIG. 19, and the curved wall 272 closes the entrance to the recessed portion 261.

When the peeling unit 250 is opened, the pin 275 is released by the cam surface 259 and freed as shown in FIG. 20. The shutter 270 thus turns counterclockwise as seen in FIG. 21, the straight wall 271 comes to the front, and thus opens the entrance to the recessed portion 261.

The shutter 270, pin 275, and cam surface 259 in a label printer 201 according to this third embodiment of the invention thus form an operation control mechanism whereby the shutter 270 moves to a position opening the entrance to the recessed portion 261 when the peeling unit 250 is opened, thus enabling operating the printer cover release lever 260, and the shutter 270 moves to a position closing the opening to the recessed portion 261 when the peeling unit 250 is closed, thus disabling operating the printer cover release lever 260.

Furthermore, the mode selection switch 19 is located in a label printer 201 according to this third embodiment of the invention in a position where the switch can only be operated when the peeling unit 250 that forms the cover unit is open as shown in FIG. 14. More particularly, the mode selection switch is positioned inside the printer housing 202 at a position where the switch is exposed and accessible when the peeling unit 250 is open and hidden and inaccessible when the peeling unit 250 is closed.

When the label-dispensing mode is changed by changing the transportation path through which the web 301 is loaded, a control unit (not shown in the figure) inside the printer housing 202 recognizes the mode change and changes paper transportation control and printing control. The mode selection switch 19 is a manual switch for reporting this mode change (that is, which label dispensing mode is set) to the host computer, and can send a selection signal corresponding to the selected label dispensing mode based on the position of the switch to the host computer.

The position of the mode selection switch 19 can be visually observed from the mode indicator (display means) 305 located on the front or other external part of the printer housing 202. This mode indicator 305 can be located anywhere on the outside where the mode indicator 305 is visible when the peeling unit 250 is closed, and the mode indicator 305 can be a mechanical indicator or an electrical indicator using LEDs, for example. A feed switch 200 (label feed switch) is also provided.

Operation of a label printer 201 according to this third embodiment of the invention is described next.

When the label dispensing mode is set to the peeling mode, the label printer 201 of this third embodiment intermittently advances the label paper 300 having a plurality of labels 302 affixed to a web 301 while printing the labels 302 with the thermal print head 213 as shown in FIG. 17 and FIG. 22 (*a*).

As the label paper 300 is conveyed with the back of the web 301 pressed against and curving acutely around the web-bending guide 214 of the peeling unit 250, the labels 302 are peeled from the web 301 travelling a curved path.

After being peeled from the web 301, the printed labels 302 then travel through the label-guiding path 221 to the label dispensing slot 208 and are detected by the peeled label detector 400 while the web 301 passes through the web-guiding path 222 and is discharged from the web discharge slot 207. Based on the detection result from the peeled label detector 400, the controller (not shown in the figure) inside the printer housing 202 controls the paper transportation and printing operations, and sends the detection result (whether there is paper or not) to the host computer.

If the peeled label detector 400 is a reflection type photodetector, the peeled label detector 400 detects labels 302 by detecting the reflection of light emitted to the labels 302. If the operator removes the peeled labels 302, the emitted light will not be reflected and the peeled label detector 400 can sense that a label 302 is not present. Because the printed label paper 300 is always present in the label dispensing slot 208 when operating in the non-peeling mode, the emitted light is continuously detected by the peeled label detector 400 and whether labels are present can be determined.

Therefore, if the peeled label detector 400 detects that the emitted light is not reflected even though the label-dispensing mode is set to the non-peeling mode, the operator mistakenly loaded the label paper to the transportation path for the peeling mode. The label printer 201 therefore stops printing, error LED 401 flashes to inform the operator of an error, and information indicating that the paper is not correctly loaded is sent to the host computer.

Furthermore, if the label-dispensing mode is set to the peeling mode but the peeled label detector 400 detects that the emitted light is continuously reflected even after the label paper is conveyed a distance greater than the specific length of the labels 302, the operator mistakenly loaded the label paper into the transportation path for the non-peeling mode. The label printer 201 therefore stops printing, error LED 401 flashes to inform the operator of an error, and information indicating that the paper is not correctly loaded is sent to the host computer.

Based on this information, the host computer can stop outputting print data or display a prompt asking the operator to correct the problem.

If the label dispensing mode is set to the non-peeling mode, the labels 302 are printed continuously by the thermal print head 213 while continuously conveying the label paper 300 as shown in FIG. 22 (*b*). The printed label paper 300 then passes through the label-guiding path 221 and is discharged from the label dispensing slot 208.

To change the label dispensing mode the printer cover 203 is left closed and only the peeling unit 250 is opened. This opens both the label-guiding path 221 and web-guiding path 222, and enables threading the label paper 300 easily through the desired path. More specifically, the web 301 of the label paper 300 is fed through the web-guiding path 222 to set the peeling mode, and the label paper 300 is fed through the label-guiding path 221 to set the non-peeling mode.

The printer cover 203, which requires much space to open, therefore does not need to be opened to change the label dispensing mode, a small opening and closing space is sufficient, and operation is simple.

Furthermore, because opening the printer cover 203 is not necessary, the label paper 300 remains held between the thermal print head 213 and platen roller 212, the position of the labels 302 does not change, and printing can continue after the dispensing mode is changed.

The printer cover 203 can thus be opened only when clear access to the inside of the printer housing 202 is needed, such as when replacing the roll of paper 209.

Furthermore, by providing a shutter 270 to this label printer 201, the printer cover release lever 260 of the printer cover 203 cannot be operated unless the peeling unit 250 is open, and the operating sequence of opening the printer cover 203 after opening the peeling unit 250 is automatically enforced.

More specifically, opening the printer cover 203 is only allowed after the peeling unit 250 is opened before the printer cover 203, the label-guiding path 221 and web-guiding path 222 are opened, and the leading end portion of the label paper 300 is released. This eliminates the leading end of the label paper 300 held in the peeling unit 250 from being unnecessarily pulled out as a result of accidentally opening the printer cover 203, and thus eliminates waste of labels 302.

More specifically, the printer cover release lever 260 cannot be operated when the recessed portion 261 is closed by the shutter 270 as shown in FIG. 19, but the printer cover release lever 260 can be opened when the shutter 270 is open as shown in FIG. 21.

Operation can thus be reliably limited with a simple construction. Furthermore, because a shutter 270 that indicates whether operation of the printer cover release lever 260 is allowed or not allowed is positioned on the printer cover release lever 260, to which the operator can directly apply force with a finger, the printer cover release lever 260 should not be mistakenly operated and excess force should not be applied to the printer cover 203.

Furthermore, because the peeling unit 250 is assembled on the printer cover 203 in a label printer 201 according to this third embodiment of the invention, opening the printer cover 203 opens the roll paper compartment 204 of the printer housing 202 and exposes the peeling unit 250 from the printer housing 202.

This makes it easier to load the label paper 300 into the label printer 201, and to remove web 301 and labels 302 jammed in the label-guiding path 221 or web-guiding path 222 of the peeling unit 250.

Furthermore, by assembling the platen roller 212 of the printing mechanism 240 on the printer cover 203 side, opening the printer cover 203 opens the label paper 300 transportation path 211 between the thermal print head 213 and platen roller 212, enables the leading end of the label paper 300 to be passed through the printing mechanism 240, and improves the ease of removing label paper 300 jammed in the transportation path 211.

As shown in FIG. 13 and FIG. 14, the label-guiding path 221 and web-guiding path 222 can be opened and the path through which the label paper 300 is loaded can be changed by opening the peeling unit 250 while the printer cover 203 remains closed in order to change the label dispensing mode.

Opening the main cover 203, which requires a large space to open as shown in FIG. 16, is therefore not necessary and less opening and closing space is needed to change the label dispensing mode.

The mode selection switch 19 for changing the label-dispensing mode is also located inside the printer housing 202.

The operator can therefore change the operating mode when desired even while the label printer 201 is operating, and the peeled label detector 400 can detect if the operator has loaded the label paper 300 into the wrong label-guiding path 221 or web-guiding path 222 or selected the wrong label-dispensing mode. The operator can thus quickly change the mode setting and thereby reduce wasted labels 302.

Furthermore, if the peeling unit 250 is opened during printer operation, a cover opening detection unit not shown can detect that the peeling unit 250 is open, the label printer 1 can thus be taken off-line, and the printer control unit can stop operation if the label paper 300 is still being transported and the printing mechanism 240 is printing. The operator can then operate the mode selection switch 19 and change the label-dispensing mode of the label printer 201.

Furthermore, because the mode selection switch 19 cannot be accessed when the peeling unit 250 is closed, the likelihood of the switch being accidentally operated while the label printer 201 is operating can be reduced compared with an arrangement in which the mode selection switch 19 is located on the outside of the printer.

The label printer 201 according to this third embodiment of the invention also has a mode indicator 305 for displaying what label dispensing mode was selected in conjunction with the mode selection switch 19 on the front of the printer housing 202. As a result, the position of the mode selection switch 19, which is located inside the printer housing 202 and cannot be operated when the peeling unit 250 is closed, can be easily visually confirmed. The mode indicator 305 is preferably an LED, and could be a key top connected to the mode selection switch 19.

If the mode selection switch 19 has a lever enabling the switch position to be known, the mode selection switch 19 can be located at the position of the mode indicator 305. The mode selection switch 19 is positioned further inside the label printer 201 in this case so that the mode selection switch 19 cannot be accessed when the peeling unit 250 is closed. The mode selection switch 19 can thus only be accessed when the peeling unit 250 is open. What dispensing mode is set can be known by the operator externally checking the position of the lever of the mode selection switch 19.

A label printer 201 according to this third embodiment of the invention thus enables changing the transportation path of the label paper 300 to either the label-guiding path 221 or web-guiding path 222 within a small working space, enables the operator to change the dispensing mode as desired even while the printer is operating, and prevents label waste by detecting when the position of the mode selection switch 19 and the transportation path of the label paper 300 do not match.

The arrangement of the printing mechanism, label peeling mechanism, printer housing, printer cover, mode selection switch, and display in a label printer according to the present invention shall not be limited to the foregoing embodiments of the present invention and can be varied in many ways without departing from the scope of the accompanying claims.

For example, a printing mechanism 240 having a thermal print head 213 is described in the foregoing embodiments, but printing mechanisms using other types of print heads, including an inkjet print head, can be used alternatively.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A label printer, enclosed by a printer housing, that enables selection of a peeling mode for peeling printed labels from a label paper web or a non-peeling mode for continuously outputting printed labels without separating the labels from the label paper web, the label printer comprising:

a first paper transportation path through which the label paper is inserted in the non-peeling mode;

a second paper transportation path through which the label paper is inserted in the peeling mode;

a cover unit that is openable to allow handling of the label paper inside the printer housing;

a mode selection switch that is accessible only when the cover unit is open, the mode selection switch outputting a selection signal according to the label-dispensing mode that is selected when the mode selection switch is operated; and a label-dispensing mode selection unit that selects the label-dispensing mode used for operation according to the selection signal output by the mode selection switch.

2. The label printer as described in claim 1, further comprising a cover opening detection unit that takes the label printer off-line when the cover unit is open.

3. The label printer as described in claim 2, wherein the cover unit opening detection unit includes a printer cover sensor that takes the printer off-line when the cover unit is open and returns the printer on-line when the cover unit is closed, and wherein the mode selection switch detects which mode is set when the cover unit is closed and the printer returns on-line.

4. The label printer as described in claim 1, wherein the mode selection switch is a slide switch and the position of the switch is visible external to the printer housing.

5. The label printer as described in claim 1, wherein the mode selection switch is a pushbutton switch that is enabled only one time when the cover unit is opened, and a one-time activation of the pushbutton switch causes the label-dispensing mode selection unit to change the label-dispensing mode.

6. The label printer as described in claims 1, further comprising a paper detector that detects the presence of the label paper web in the second paper transportation path; and an error indicator that indicates an error when the label-dispensing mode selected by the label-dispensing mode selection unit and the paper path in which the label paper is inserted do not match.

7. The label printer as described in claim 1, wherein the cover unit comprises a label peeling mechanism for peeling labels from a web conveyed through a curved path by bending printed label paper acutely from the back side, and having a peeled label detector for detecting peeled labels;

wherein the label peeling mechanism is openable and closable from the cover unit, so that the first paper transportation path and second paper transportation path can be opened.

8. The label printer as described in claim 7, wherein the mode selection switch is covered by the label peeling mechanism such that the mode selection switch is inaccessible when the label peeling mechanism is closed.

9. The label printer as described in claim 8, further comprising a mode indicator that displays externally to the printer housing the label dispensing mode selected by the mode selection switch.

* * * * *